US005363648A

United States Patent [19]

Akazaki et al.

[11] Patent Number: 5,363,648

[45] Date of Patent: Nov. 15, 1994

[54] A/F RATIO CONTROL SYSTEM FOR INTERNAL COMBUSTION ENGINE

[75] Inventors: Shusuke Akazaki; Yusuke Hasegawa; Yoichi Nishimura; Isao Komoriya, all of Saitama, Japan

[73] Assignee: Honda Giken Kogyo Kabushiki Kaisha, Tokyo, Japan

[21] Appl. No.: 172,896

[22] Filed: Dec. 27, 1993

[30] Foreign Application Priority Data

Dec. 29, 1992 [JP] Japan ..... 4-360919

[51] Int. Cl.[5] ..... F01N 3/22

[52] U.S. Cl. ..... 60/276; 60/277; 60/285; 123/703

[58] Field of Search ..... 60/274, 276, 277, 285; 123/703, 445, 672, 674

[56] References Cited

U.S. PATENT DOCUMENTS 5,074,113 12/1991 Matsuoka ..... 60/285
5,119,628 6/1992 Uema ..... 60/276
5,154,055 10/1992 Nakane ..... 60/276
5,158,063 10/1992 Hosoda ..... 60/277

FOREIGN PATENT DOCUMENTS 64-56935 3/1989 Japan .

*Primary Examiner*—Ira S. Lazarus
*Assistant Examiner*—Daniel J. O'Connor
*Attorney, Agent, or Firm*—Nikaido, Marmelstein, Murray & Oram

[57] ABSTRACT

A system for controlling an air/fuel ratio of a four-cylinder internal combustion engine. In the system, an actual air/fuel ratio, at least at upstream or downstream of a catalytic converter installed at an exhaust system of the engine, is intentionally oscillated at least either in its amplitude or cycle. A characteristic of a desired air/fuel ratio as a periodic function is established with respect to time such that the desired air/fuel ratio varies at least either at a predetermined amplitude or cycle within a predetermined period. The characteristic is sampled by a time interval determined on the basis of a time interval between TDC crank angle positions of the engine. Each cylinder's desired air/fuel ratio is then determined from the sampled data, and a fuel injection amount for each cylinder is determined from the respective cylinder's desired air/fuel ratios. Fuel is then supplied to each cylinder in response to the determined fuel injection amount. The actual air/fuel ratio at each cylinder is detected or estimated and feedback controlled to the desired air/fuel ratio.

39 Claims, 26 Drawing Sheets

A/F RATIO CONTROL SYSTEM FOR INTERNAL COMBUSTION ENGINE

BACKGROUND OF THE INVENTION

1. Field of the Invention

This invention relates to a system for controlling the air/fuel ratio of an internal combustion engine. More particularly, it relates to a system for controlling the air/fuel ratio of a multicylinder internal combustion engine in which the air/fuel ratio to be applied to the engine is intentionally perturbed or oscillated between lean and rich directions in order to enhance the purification efficiency of a catalytic converter installed at the engine's exhaust system. This is known as the perturbation effect.

2. Description of the Prior Art

The perturbation effect is often described in papers and has been a known technique, as well as the phenomenon of the catalytic converter's storage of oxygen in order to achieve the optimum purification efficiency of the catalytic converter. The catalytic converter's oxygen storage is a phenomenon in which the catalytic converter stores oxygen when the air-fuel mixture is rich and discharges the same when the air-fuel mixture is lean. The perturbation effect is explained in Japanese Laid-Open Patent Publication No. Sho 64(1989)-56,935, for example. In the prior art technique disclosed in that publication, a desired air/fuel ratio is forcibly oscillated or perturbed between the rich and lean directions, centered on the stoichiometric at a cycle (frequency) and an amplitude determined with respect to engine speed and engine load.

In the prior art technique, however, when the engine operating condition varies continually, the desired air/fuel ratio is fixed either at the lean or rich side. It therefore becomes impossible to attain the purpose of the perturbation control sufficiently to improve the purification efficiency of the catalytic converter.

An object of the invention is therefore to overcome the problem and to provide a system for controlling the air/fuel ratio of an internal combustion engine in which a desired air/fuel ratio at a predetermined cycle and amplitude is supplied to the engine irrespective of whether or not the engine is in a steady-state operating condition or a transient operating condition—in other words irrespective of the change in speed or load of the engine—so as to sufficiently enhance the purification efficiency of the catalytic converter.

Further, in the prior art technique disclosed in the publication, a single air/fuel ratio sensor is installed at a confluence point of the exhaust system of a multicylinder internal combustion engine to detect the air/fuel ratio of the mixture supplied to the engine, and the air/fuel ratio is feedback controlled to a desired value such that the error therebetween is decreased. However, the exhaust gas at the confluence point is a mixture of the exhaust gases evolved from the individual cylinders and therefore does not indicate respective air/fuel ratios at the individual cylinders. In other words, in the prior art technique, the perturbation control is not conducted separately for the individual cylinders of the engine.

A second object of the invention is to provide a system for controlling the air/fuel ratio of a multi-cylinder internal combustion engine in which the air/fuel ratio is controlled separately for the individual cylinders to conduct the perturbation more effectively, thus further improve the purification efficiency of the catalytic converter.

In the prior art technique, furthermore, the deviation between the desired air/fuel ratio and the detected air/fuel ratio is multiplied by a gain to yield a feed-back correction factor. As a result, it becomes impossible successfully to carry out the perturbation control at an engine operating condition in which air/fuel ratio control is conducted in an open-loop fashion.

A third object of the invention is therefore to provide a system for controlling an air/fuel ratio of an internal combustion engine in which the perturbation control can successfully be carried out even at an engine operating condition in which air/fuel ratio control is conducted in an open-loop fashion.

For realizing the objects, the present invention provides a system for controlling an air/fuel ratio of a multicylinder internal combustion engine such that an actual air/fuel ratio at, at least one of upstream and down-stream of a catalytic converter installed at an exhaust system of the engine, is intentionally oscillated in at least one of its amplitude and cycle. The system comprises first means for establishing a characteristic of a desired air/fuel ratio as a periodic function such that the desired air/fuel ratio varies at at least one of a predetermined amplitude and cycle within a predetermined period, second means for sampling the characteristic by a time interval determined on the basis of a time interval between TDC crank angle positions of the engine, third means for determining each cylinder's desired air/fuel ratio from the sampled data, fourth means for determining a fuel injection amount for each cylinder from each determined cylinder's desired air/fuel ratio, and fifth means for supplying a fuel to each cylinder in response to the determined fuel injection amount.

BRIEF DESCRIPTION OF THE DRAWINGS

These and other objects and advantages of the invention will be more apparent from the following description and drawings, in which.

DETAILED DESCRIPTION OF THE PREFERRED EMBODIMENTS

Figure 1:
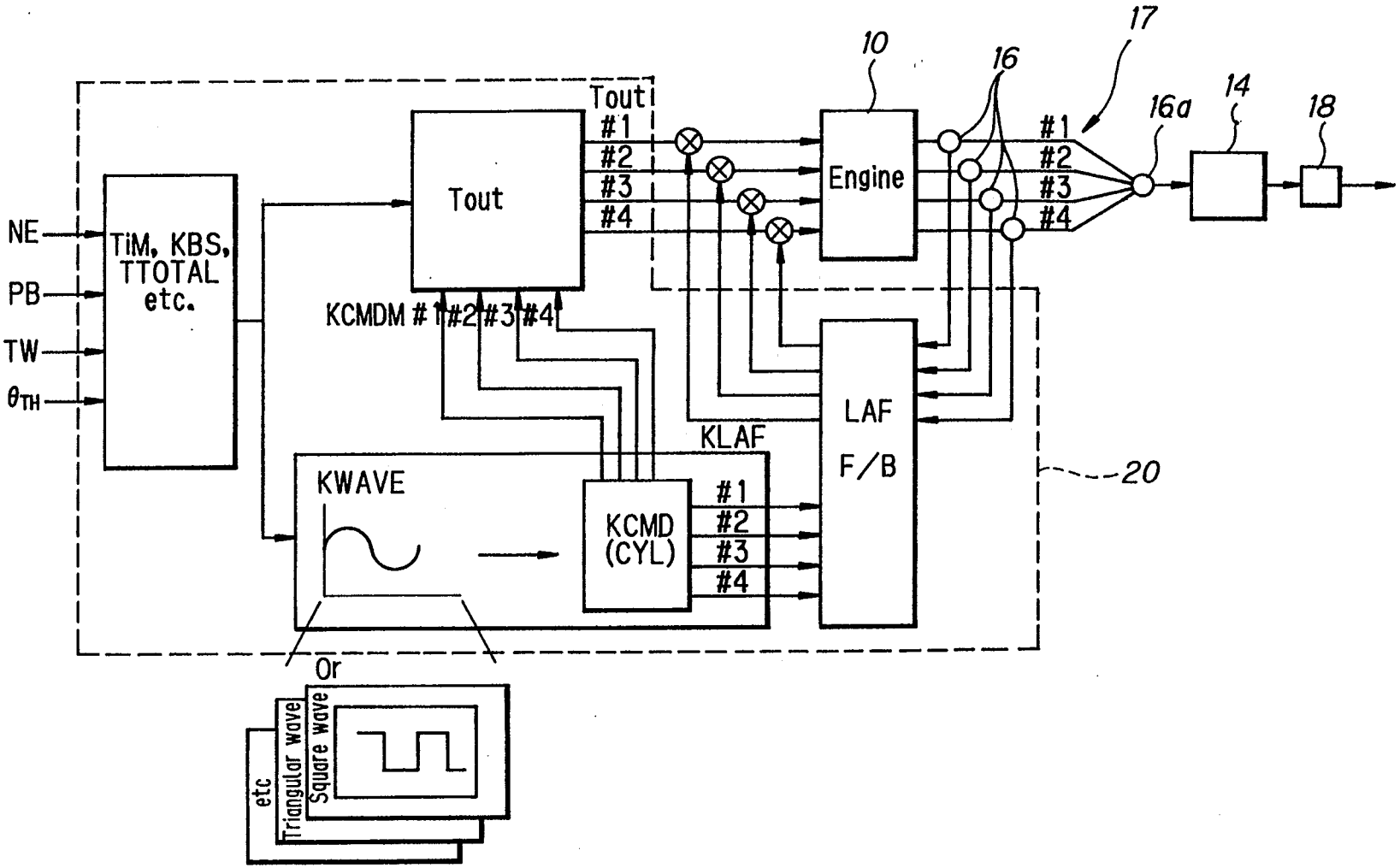
FIG. 1 is an overall block diagram showing an air/fuel ratio control system for a four-cylinder internal combustion engine according to the present invention.

FIG. 1 is an overall block diagram of an air/fuel ratio control system for a multicylinder internal combustion engine according to the present invention.

Reference numeral 10 in this figure designates an internal combustion engine having four cylinders. Air drawn in through an air intake system (not shown) is injected with fuel by each cylinder's injector (not shown), and the injected fuel mixes with the intake air to form an air-fuel mixture that is supplied to the first through fourth cylinders. The mixture is ignited there to generate combustion, and the exhaust gas produced by the combustion is supplied to an exhaust system where it is removed of noxious component by a three-way catalytic converter 14 before being discharged to the exterior.

An air/fuel ratio sensor 16, constituted as an oxygen concentration detector, is provided at each branch of an exhaust manifold 17 in the exhaust system to detect the air/fuel ratio of the exhaust gas which varies linearly with the oxygen concentration of the exhaust gas over a broad range extending from lean to rich. Since this air/fuel ratio sensor is explained in detail in the assignee's earlier Japanese Laid-Open Patent Publication No. Hei 4(1992)-369,471; also filed in the United States on May 5, 1992 under the Ser. No. of 07/878,596, it will not be explained here. Hereinafter in this explanation, the air/fuel ratio sensor 16 will be referred to as the "LAF sensor" (the name is derived from its characteristic by which the air/fuel ratio can be detected linearly).

Additionally, a fifth air/fuel ratio sensor **16*a* is provided at a confluence point downstream of the exhaust manifold 17 and upstream of the catalytic converter 14 to detect the air/fuel ratio at the confluence point of the exhaust system of the engine 10. Further, an oxygen sensor 18 is installed in the exhaust system at a point downstream of the catalytic converter 14** to output a voltage which switches from the high to low level (or vice versa), crossing the stoichiometric, in response to the oxygen con tent in the exhaust gas.

An electronic control unit 20, mainly comprised of a microcomputer, is provided to control the air/fuel ratio of the engine 10. The control unit 20 detects engine speed (shown as "NE"), manifold absolute pressure (shown as "PB"), engine coolant temperature (shown as "TW") and the like through sensors (not shown) and controls fuel injection amount to be supplied to the engine. The fuel injection amount is controlled in such a manner that the air/fuel ratio traces a desired air/fuel ratio having a predetermined cycle and amplitude, as will be explained below.

Now, the perturbation control according to the invention will be outlined.

Figure 2:
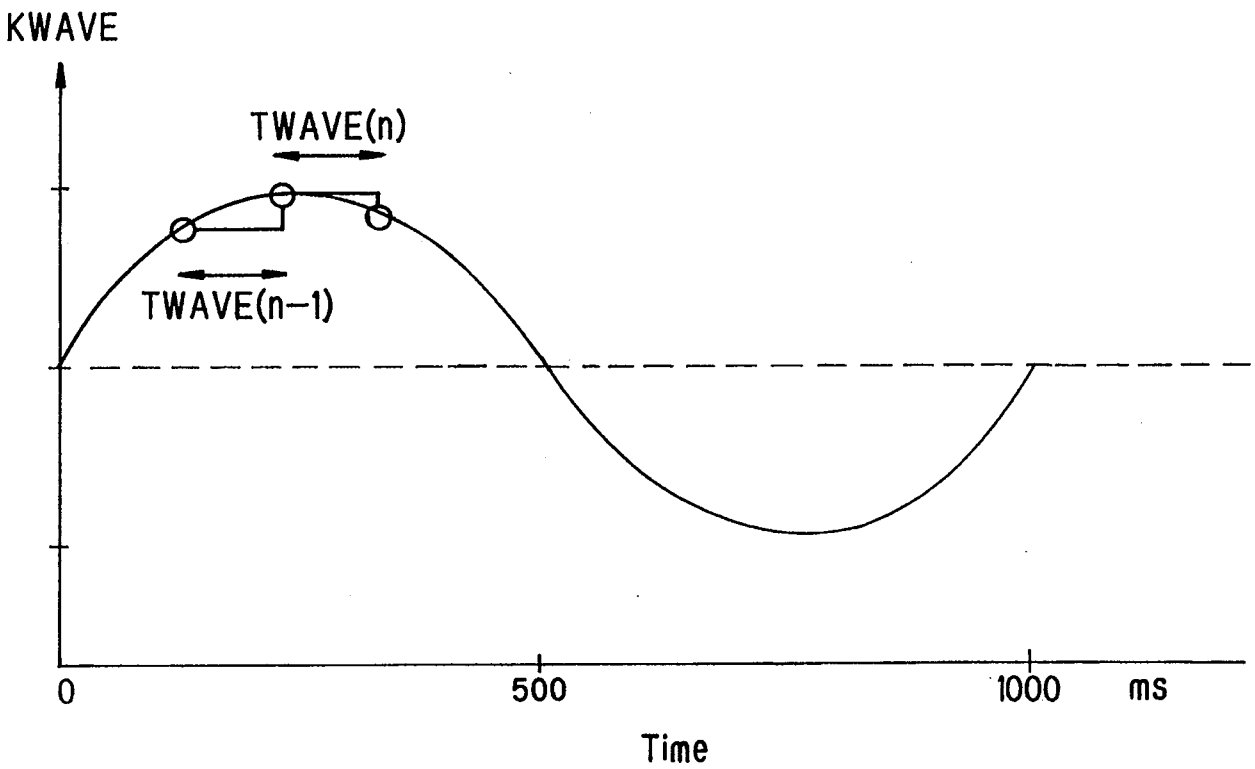
FIG. 2 is a timing chart or table showing the characteristic of a desired air/fuel ratio defined in terms of a perturbation correction factor KWAVE(n) with respect to time, to be used in the control system illustrated in FIG. 1.

As illustrated in FIG. 2, a desired air/fuel ratio is set to vary with respect to time at a predetermined cycle (1 Hz) and amplitude, and is defined in terms of a perturbation correction coefficient KWAVE. The desired air/fuel ratio is expressed as a periodic function, a sine wave (sinusoidal) in the embodiment. The period of the desired air/fuel ratio is set to be 1000 [milliseconds] as depicted. The desired air/fuel ratio is sampled by a time interval TWAVE, determined on the basis of an interval between adjacent TDC (top dead center) crank angle positions (hereinafter referred to as TDC interval ME), to determine the desired air/fuel ratio and thus a fuel injection amount Tout in a manner mentioned below.

In the control, as briefly illustrated in FIG. 1, the fuel injection amount Tout, defined in terms of a period during which the injector 12 is energized, is calculated for the individual cylinders as follows. The value is named as Tout(CYL). Similarly, a value with "(CYL)" indicates the value for each individual cylinder:

$$Tout(\mathrm{CYL}) = TiM \times KTOTAL \times KCMDM(\mathrm{CYL}) + TTOTAL + TV,$$

where

Tout(CYL)=Fuel injection amount at a given cylinder;

TiM=Basic fuel injection amount obtained by retrieving mapped data stored in a memory of the control unit 20 using engine speed NE and manifold absolute pressure PB as address data;

KTOTAL=Correction coefficient for various corrections to be multiplied;

KCMDM(CYL)=Air/fuel ratio correction coefficient at the cylinder concerned;

TTOTAL=Correction coefficient for various corrections to be added; and

TV=Correction coefficient for battery voltage to be added.

In the above, the air/fuel ratio correction coefficient KCMDM(CYL) is calculated as follows:

$$KCMDM(\mathrm{CYL}) = KCMD(\mathrm{CYL}) \times KETC,$$

where

KCMD(cyl)=Desired air/fuel ratio at the cylinder concerned;

KETC=Correction coefficient for fuel cooling.

In the above, the desired air/fuel ratio KCMD(CYL) is calculated as follows:

$$KCMD(\mathrm{CYL}) = KBS \times KWAVE \times KWOT,$$

where

KBS=Basic value obtained by retrieving mapped data using engine speed NE and manifold absolute pressure PB as address data;

KWAVE=The aforesaid perturbation correction coefficient illustrated in FIG. 2; and KWOT=Correction coefficient for power enrichment at high engine load.

The details of the perturbation control according to the invention will be explained with reference to the flowchart shown in FIG. 3.

The program begins at S10 in which the TDC interval ME is read in, and proceeds to S12 in which a cycle correction coefficient KWAVE-HZ is retrieved from mapped data stored in a memory of the control unit 20, using detected engine speed NE and manifold absolute pressure PB. The program then proceeds to S14 in which an amplitude correction coefficient KWAVE-GAIN is retrieved from a second set of mapped data similarly stored in the memory by the same parameters, and to S16 in which degradation of the catalytic converter 14 is Judged in order to correct the retrieved coefficients KWAVE-HZ and KWAVE-GAIN.

Figure 4:
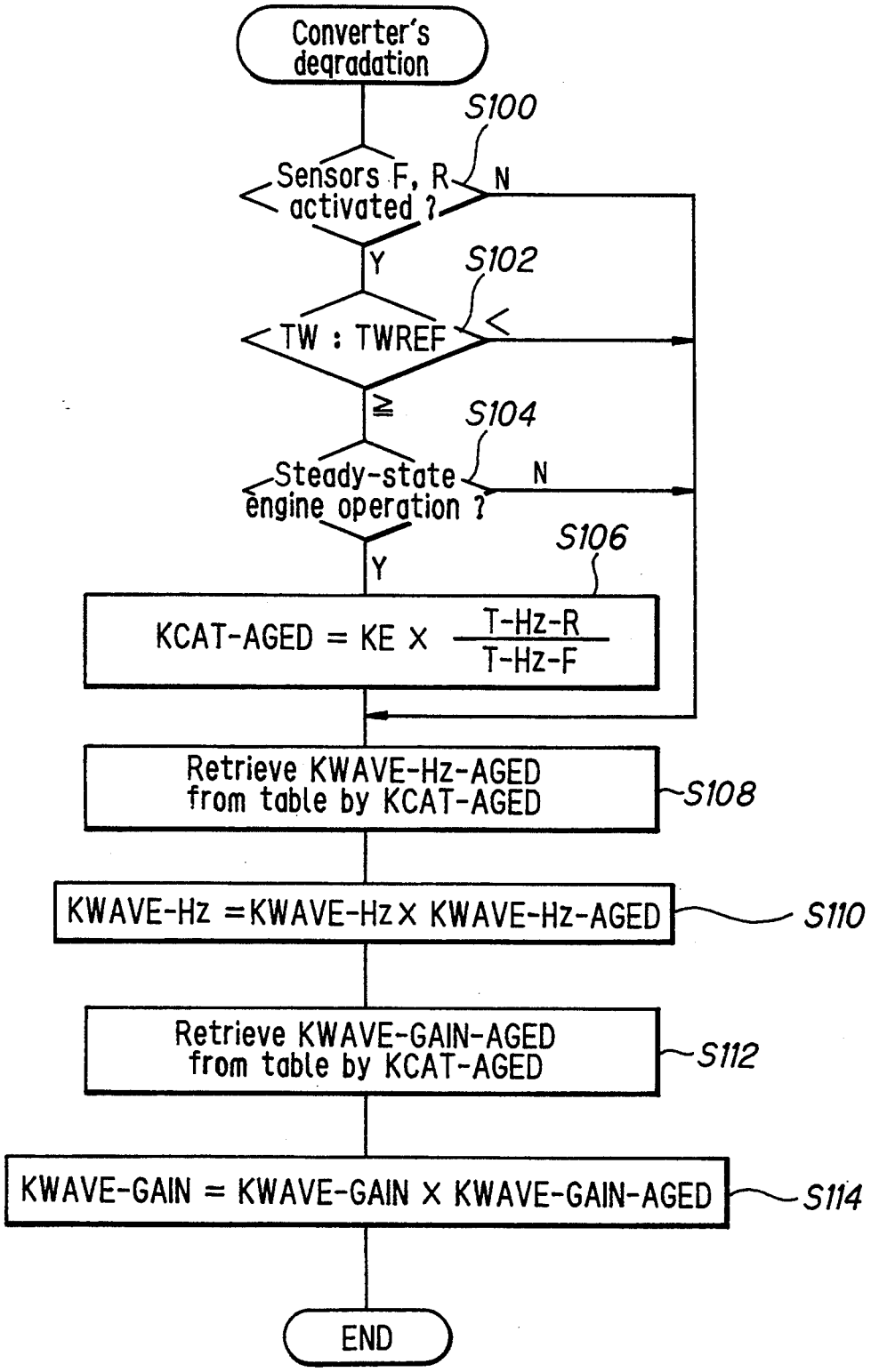
FIG. 4 is a flowchart showing a subroutine for Judging the degradation of a catalytic converter referred to in the flowchart of FIG. 3.

FIG. 4 is a flowchart showing the determination of the degree of degradation of the catalytic converter. In the configuration illustrated in FIG. 1 having the LAF sensor 16*a* upstream of the catalytic converter 14 and the oxygen sensor 18 downstream thereof, the degradation is judged by comparing switching periods (the time elapse between senor's successive switches from high to low or vice verse) of the sensors' outputs. In the flowchart, the LAF sensor 16*a* is abbreviated as sensor "F" and the oxygen sensor 18 as sensor "R".

First, it is checked at S100 by a suitable manner whether the sensors F, R have been activated. If the result is affirmative, the program proceeds to S102 in which the detected engine coolant temperature TW is compared with a reference value TWREF and if it is found that TW is not less than TWREF, i.e. that the combustion is stable, the program proceeds to S104 in which it is checked if the engine is in a steady-state operation. If so, the program proceeds to S106 in which a coefficient KCAT-AGED (coefficient indicative of the degradation degree of the catalytic converter 14) is calculated in accordance with an equation as illustrated. In the equation, T-Hz-R is obtained, through a subroutine (not shown), by measuring a time period of the sensor R's output from a point at which the sensor output moves to the high (or low) level to the next point at which the sensor output moves to the low (or high) level. T-Hz-F is similarly obtained, through another subroutine (not shown), by measuring a time period of the sensor F's output between a first point at which the sensor output crosses a predetermined reference value in a given direction and a second point at which the sensor output again crosses the reference value in the opposite direction. It should be noted that, instead of the period T-Hz-F, the period of the coefficient TWAVE illustrated in FIG. 2, i.e., 1000 [milliseconds] may be used. The value KE in the equation is a correction coefficient which is set to vary with the engine speed NE.

It should also be noted here that both periods T-Hz-R,L are weight-averaged and that the resultant averages are used as the periods. For example, the weight-averaging for T-Hz-R is determined thus:

$$T\text{-}Hz\text{-}R = (T\text{-}Hz\text{-}R(n) \times A) + (T\text{-}Hz\text{-}R(n-1) \times (1-A)),\ (A \leqq 1)$$

where (n) denotes the value at the current computation cycle and (n−1) the value 1 computation cycle earlier. The coefficient KCAT-AGED thus obtained will be stored in a back-up RAM portion of the memory of the control unit 20.

The program now proceeds to S108 in which a correction coefficient KWAVE-Hz-AGED is obtained by retrieving a table stored in the memory using the coefficient KCAT-AGED obtained in S106 as an address datum, and to S110 in which the coefficient KWAVE-Hz-AGED is multiplied to the coefficient KWAVE-Hz to correct the same.

Figure 5:
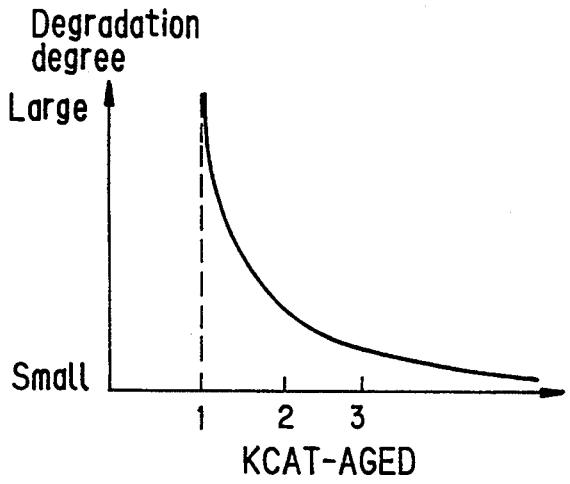
FIG. 5 is a view explaining the characteristic of a coefficient KWAVE-Hz-AGED referred to in the flowchart of FIG. 4.
Figure 6:
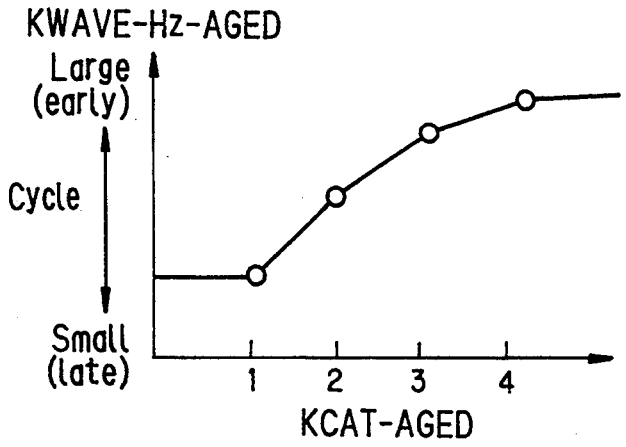
FIG. 6 is a view showing the characteristic of the coefficient KWAVE-Hz-AGED referred to in FIG. 5.

FIG. 5 and following illustrate the characteristics of the coefficient KWAVE-Hz-AGED. As will be understood from FIG. 5, it can be said that the degradation degree of the catalytic converter 14 increases as the difference between the periods T-Hz-R,L of the sensors R,L installed upstream and downstream of the catalytic converter 14 increases. In other words, it can be said that the degradation increases as the coefficient KCAT-AGED decreases. As illustrated in FIG. 6, accordingly, the correction coefficient KWAVE-Hz-AGED is established in such a manner that, as the degradation of the catalytic converter increases, the cycle of the desired air/fuel ratio is corrected to be lessened (delayed).

Figure 7:
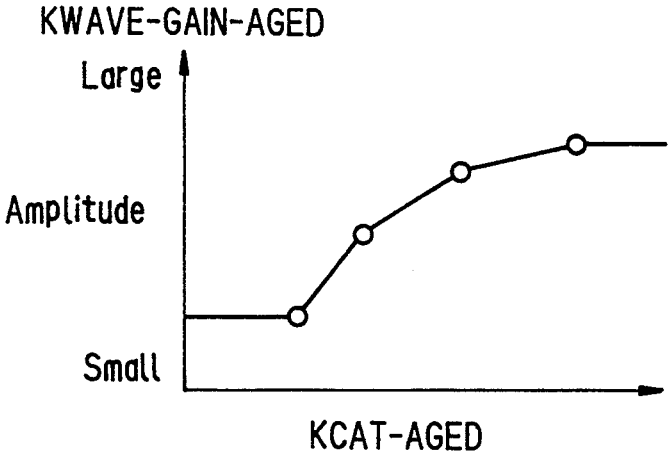
FIG. 7 is a view showing the characteristic of another coefficient KWAVE-GAIN-AGED referred to in the flowchart of FIG. 4.

The program then proceeds to S112 in which a correction coefficient KWAVE-GAIN-AGED for the amplitude correction coefficient KWAVE-GAIN is similarly retrieved from a table (whose characteristic is shown in FIG. 7), and then to S114 in which the factor KWAVE-GAIN is multiplied by the retrieved correction coefficient KWAVE-GAIN-AGED to correct the same. The coefficient is established, for the same reason, such that the amplitude of the desired air/fuel ratio be lessened as the degradation degree of the catalytic converter increases.

Figure 3:
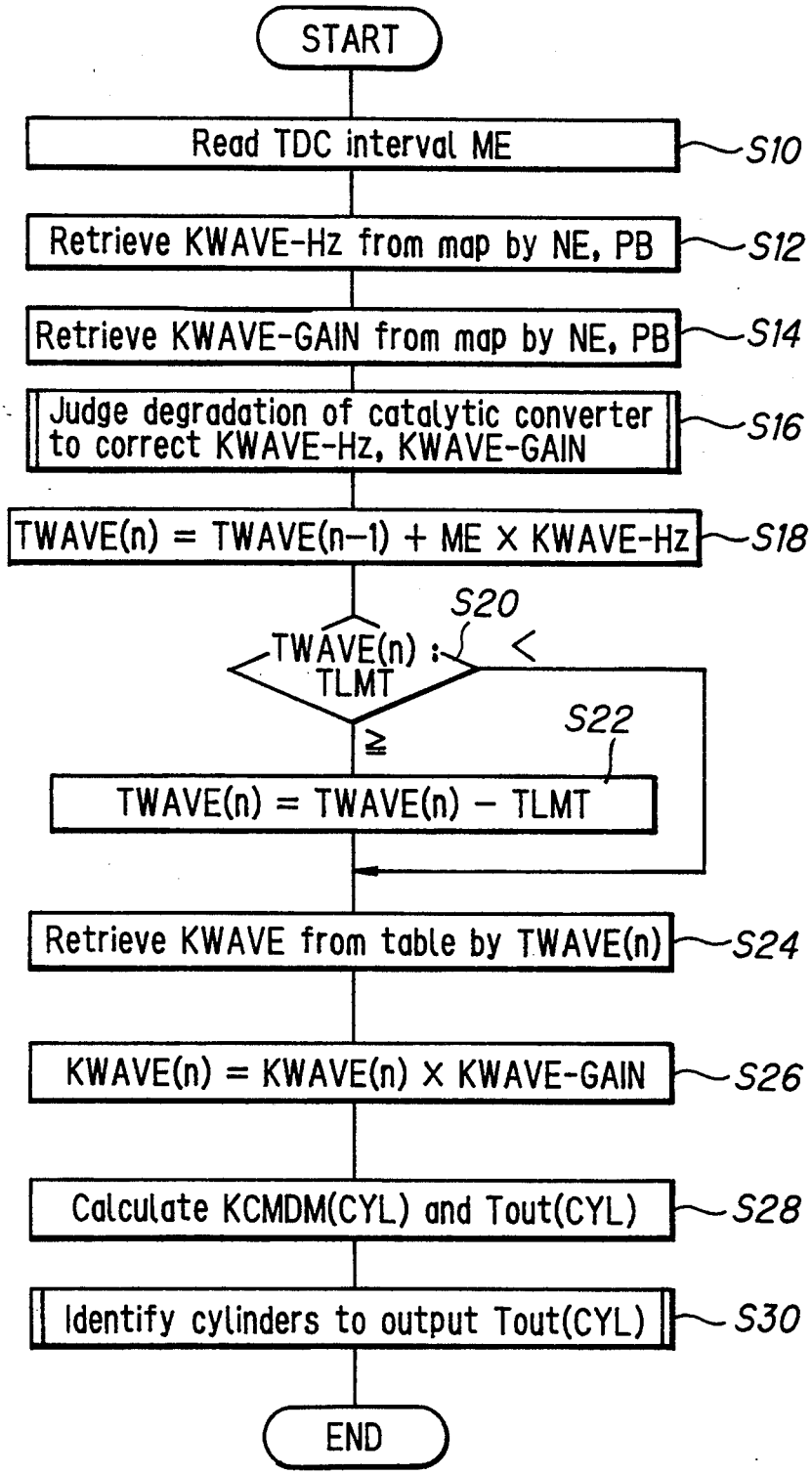
FIG. 3 is a flowchart showing the main routine of a perturbation control carried out by the control system illustrated in FIG. 1.

Returning to the flowchart of FIG. 3, the program proceeds to S18 in which the sampling time interval TWAVE(n) (at the current computation cycle) for the KWAVE table retrieval is calculated. This is done, as illustrated, by multiplying the TDC interval ME by the cycle coefficient KWAVE-Hz and adding the product to TWAVE(n−1) (the value 1 computation cycle earlier). The program then proceeds to S20 in which the value TWAVE(n) thus obtained is compared with a predetermined limit TLMT (identical to the period (1000 [milliseconds] in FIG. 2). If the value TWAVE(n) is found to be equal to or greater than the limit TLMT, the program proceeds to S22 in which the limit TLMT is subtracted from the value TWAVE(n) to correct the same. With this arrangement, the value TWAVE(n) is limited at or below than the predetermined limit. Thus, the perturbation correction coefficient is determined at one interval after another as illustrated in FIG. 2, and if the interval meets or exceeds the period, it is returned to the beginning. The program then proceeds to S24 in which the perturbation correction coefficient KWAVE(n) is retrieved by the sampling time interval TWAVE(n), and to step S26 in which the perturbation correction coefficient KWAVE(n) is multiplied by the amplitude correction coefficient KWAVE-GAIN to correct the same.

Figure 8:
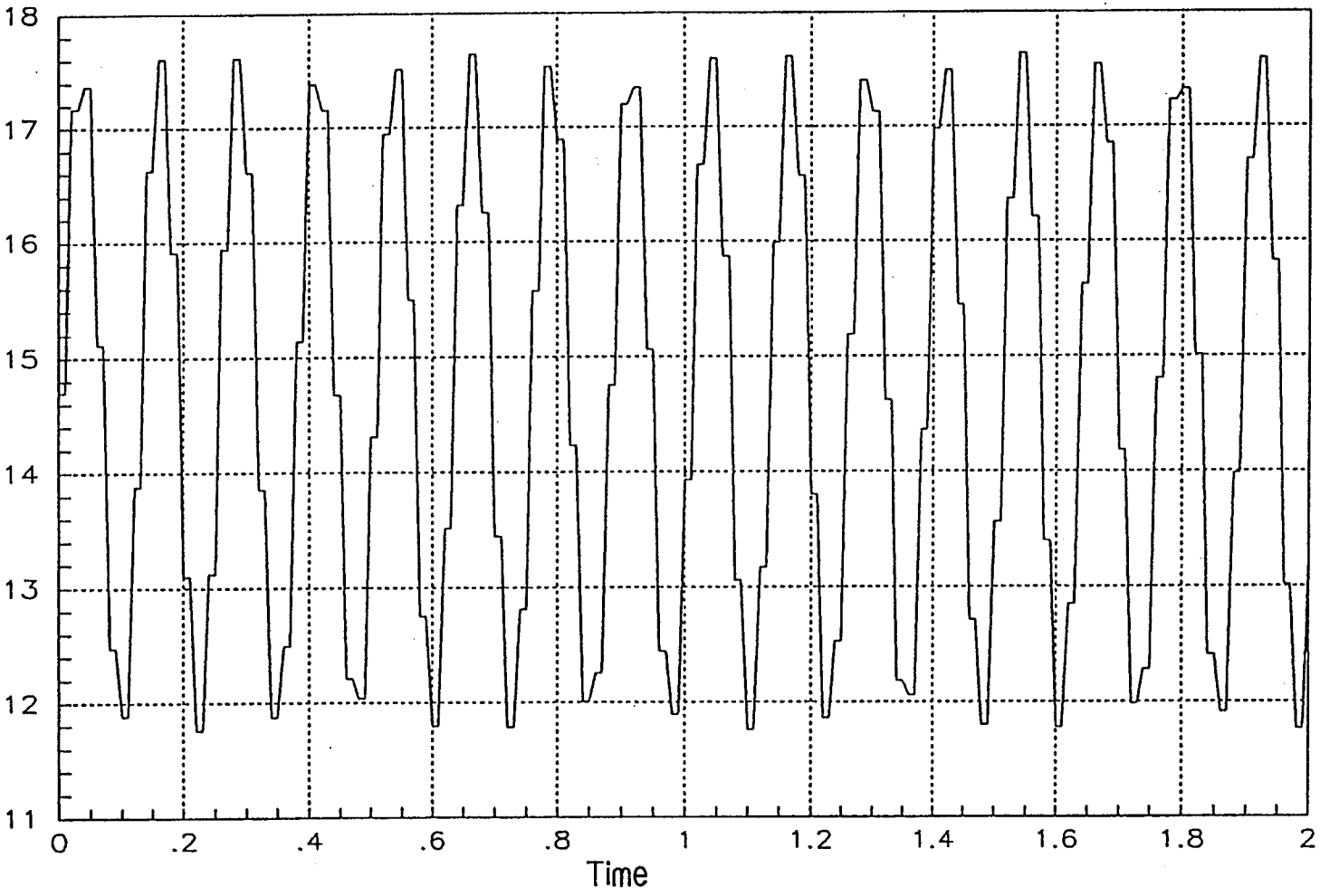
FIG. 8 is the result of a simulation showing a desired air/fuel ratio obtained by sampling the characteristic illustrated in FIG. 2 over a TDC interval.
Figure 9:
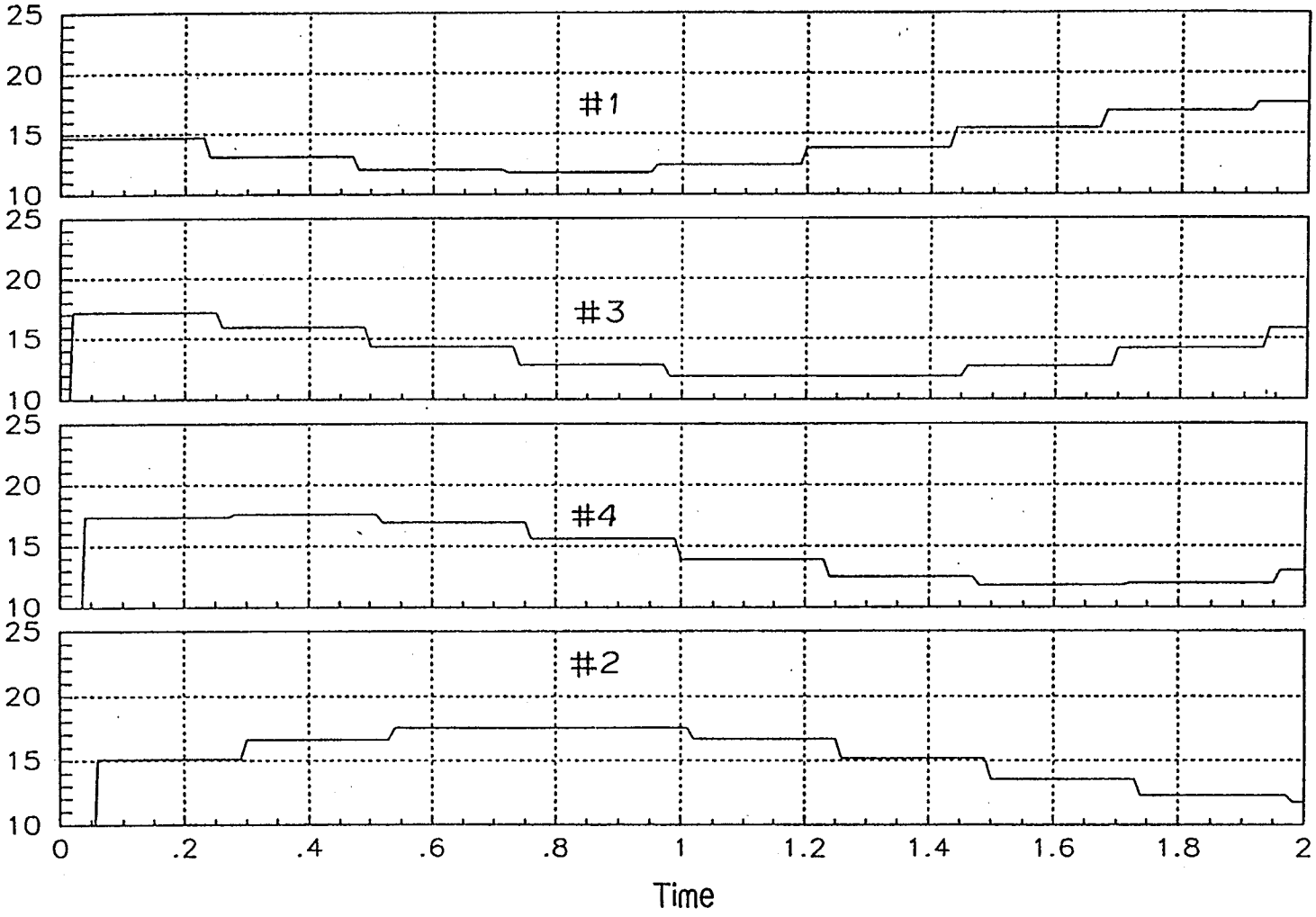
FIG. 9 is the result of a simulation showing desired air/fuel ratios at the individual cylinders obtained by distributing the desired air/fuel ratio illustrated in FIG. 8 to the individual cylinders.
Figure 10:
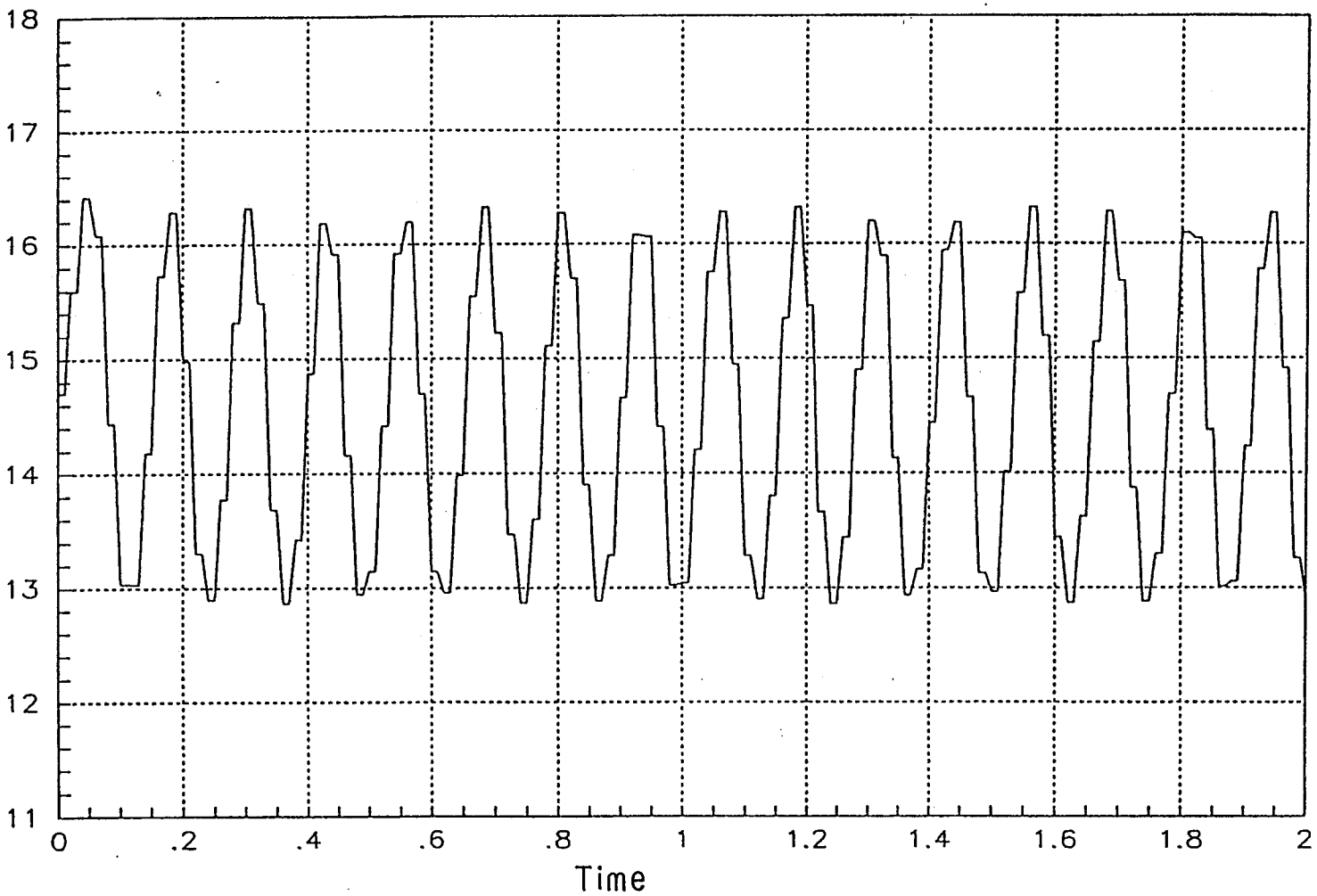
FIG. 10 is the result of a simulation showing an air/fuel ratio output (at a confluence point of the exhaust system of the engine) when the air/fuel ratios illustrated in FIG. 9 are supplied to the individual cylinders.

The amplitude correction coefficient KWAVE-GAIN will now be explained further. FIGS. 8 through 10 illustrate the result of a simulation in which the desired air/fuel ratio was discretized (sampled) from the table of FIG. 2 by the TDC interval and in response to the desired air/fuel ratio thus obtained, fuel was supplied. FIG. 8 illustrates the sampled data obtained and FIG. 9 illustrates the desired air/fuel ratios at the individual cylinders obtained by distributing the sampled data to the four cylinders. FIG. 10 illustrates the air/fuel ratio at the exhaust confluence point when fuel was supplied in response to the desired air/fuel ratios determined for the four cylinders. As can be seen in FIG. 10, the amplitude of the air/fuel ratio at the exhaust confluence point is decreased from the initial value shown in FIG. 8. This is because, the air/fuel ratio at the exhaust confluence point is considered to be a mixture of the air/fuel ratios at the individual cylinders and hence the amplitude would be averaged. However, since the cycle (frequency) was the same as that of the initial value in FIG. 8, it was considered that the discrepancy could be adjusted by increasing the desired air/fuel ratio by a gain coefficient.

The amplitude correction coefficient KWAVE-GAIN is introduced for that purpose. However, since it is considered preferable, in order to enhance the perturbation effect, to vary the desired air/fuel ratio in response to the change in the engine operating parameters such as the engine speed NE or the manifold absolute pressure PB (or the engine coolant temperature TW) or the degradation degree of the catalytic converter, it is arranged such that the amplitude is also corrected in view of the change in engine operating conditions or the like. The cycle correction coefficient KWAVE-Hz is adjusted for the same reason. To be more specific, it is arranged in the invention such that, whatever the engine operating parameters such as the engine speed NE and the manifold absolute pressure PB may be, the desired air/fuel ratio is enabled to be supplied to the engine at a constant cycle and a constant amplitude. At the same time, the cycle and amplitude of the desired air/fuel ratio are varied in response to changes in the engine operating parameters such as the engine speed NE or the manifold absolute pressure PB.

In the flowchart of FIG. 3, the program goes to S28 in which the air/fuel ratio correction coefficient KCMDM(CYL) and fuel injection amount Tout for the individual cylinders are calculated in the fashion explained above. An LAF F/B section illustrated in FIG. 1 is provided with a PID controller (not shown) and calculates an F/B correction coefficient KLAF, which is multiplied by the determined fuel injection amount Tout(CYL) such that the difference between the desired air/fuel ratio and the actual air/fuel ratio at each cylinder detected by the LAF sensor 16 decreases. The program then proceeds to S30 in which the cylinders are identified.

Figure 11:
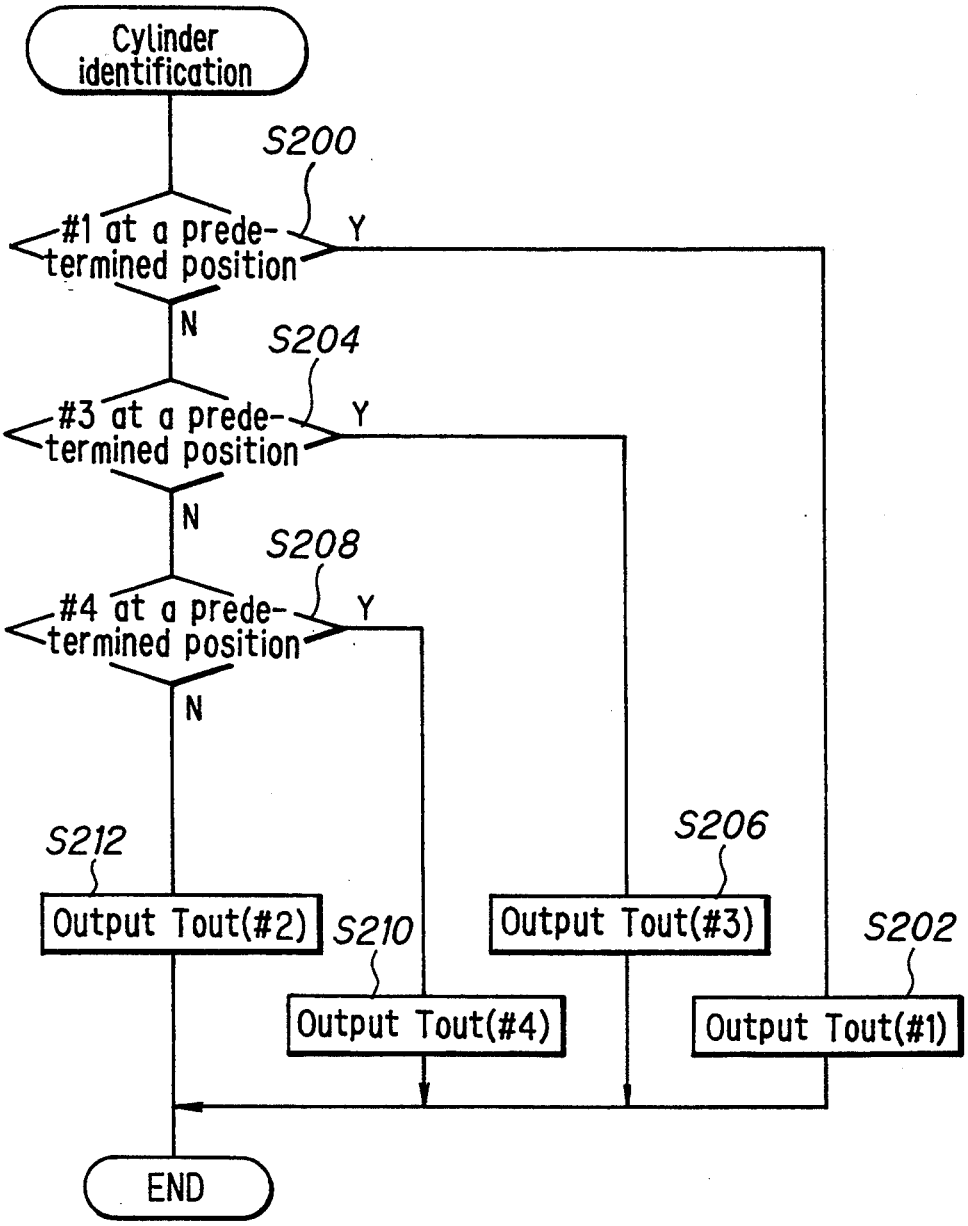
FIG. 11 is a flowchart showing a subroutine for identifying the cylinders referred to in the flowchart of FIG. 3.

FIG. 11 is a flowchart showing the subroutine of the cylinders identification. The program starts at S200 in which a check is made as whether or not the first cylinder is at a predetermined crank angle position. If the judgment is affirmative, the program advances to S202 in which the fuel injection amount Tout(#1) for the first cylinder is output. If not, the program proceeds to steps S204 through S212 in which the fuel injection amounts for the respective cylinders are output one after another in the firing order.

Figure 12:
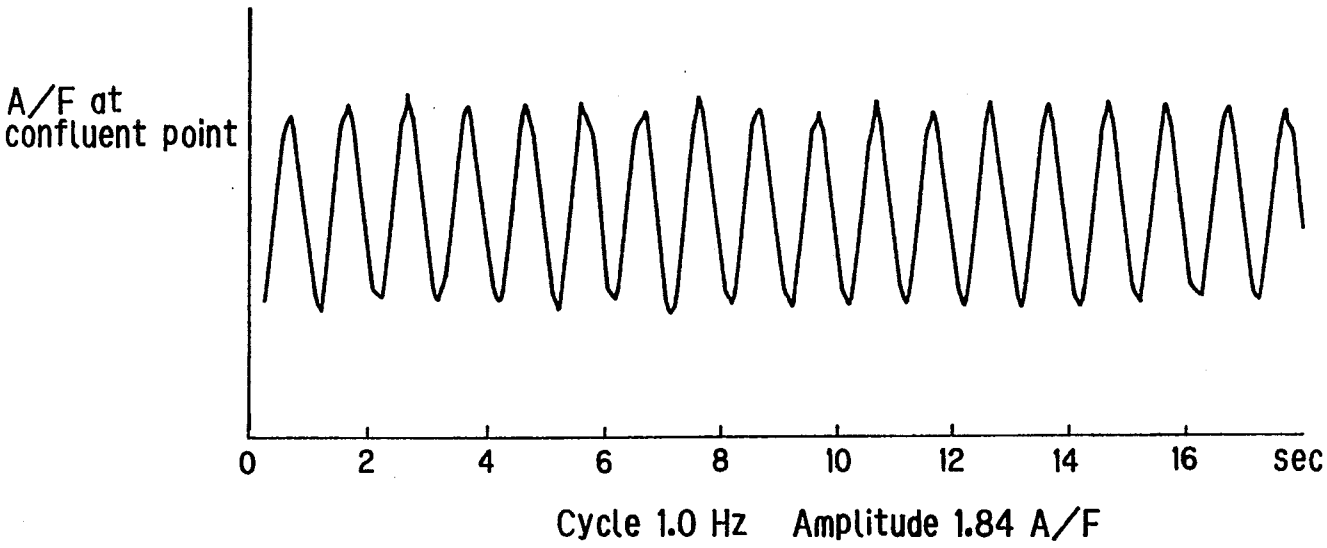
FIG. 12 is the result of a test conducted on a test engine at a steady-state engine operating condition when the cycle and amplitude of the desired air/fuel ratio are set at 1.0 Hz and 1.84 A/F.
Figure 13:
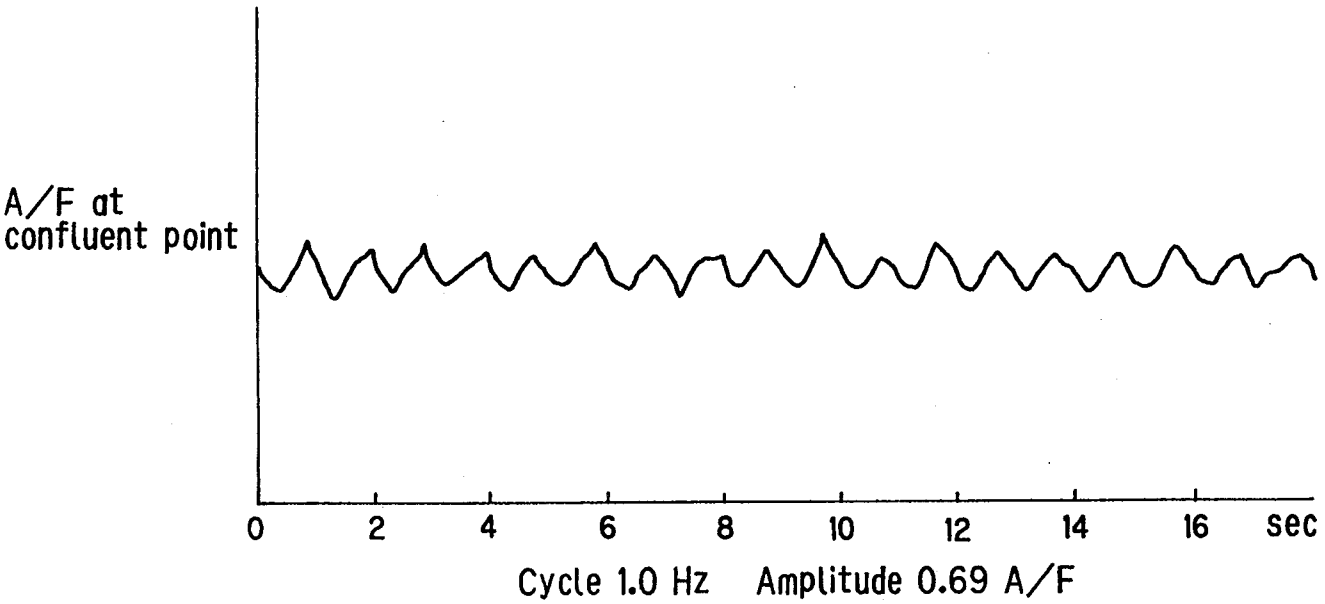
FIG. 13 is a view similar to FIG. 12 but when the cycle and amplitude of the desired air/fuel ratio are set at 1.0 Hz and 0.69 A/F.
Figure 14:
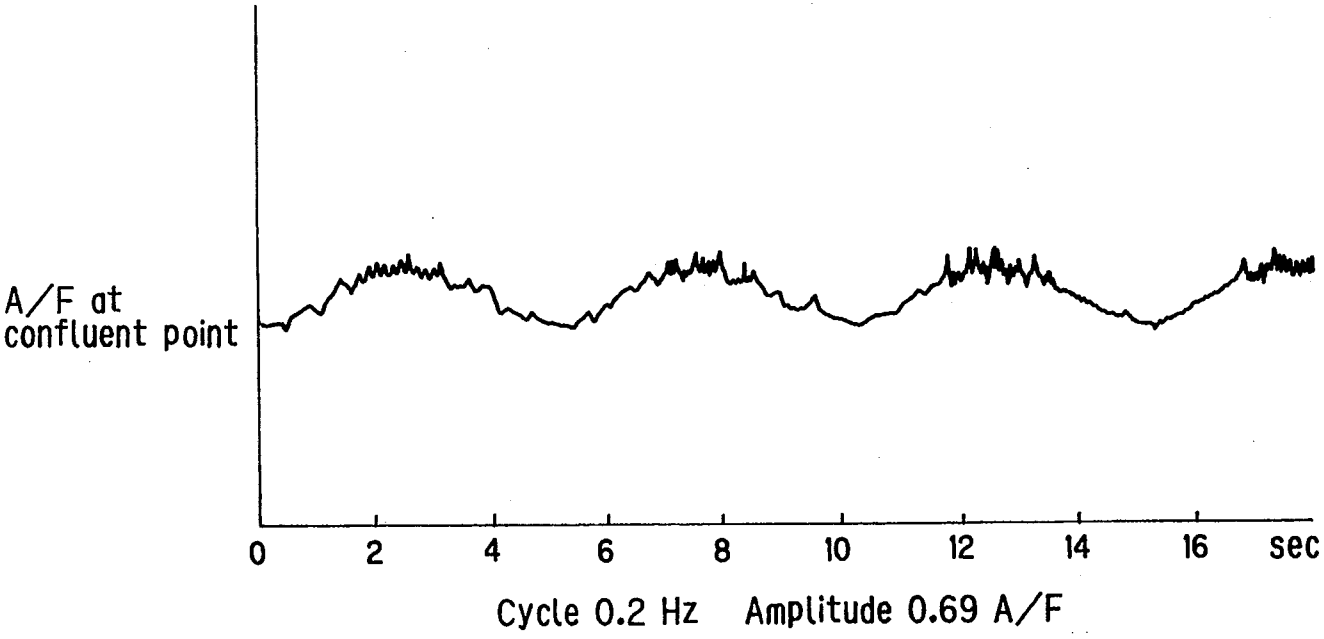
FIG. 14 is a view similar to FIG. 12 but when the cycle and amplitude of the desired air/fuel ratio are set at 0.2 Hz and 0.69 A/F.
Figure 15:
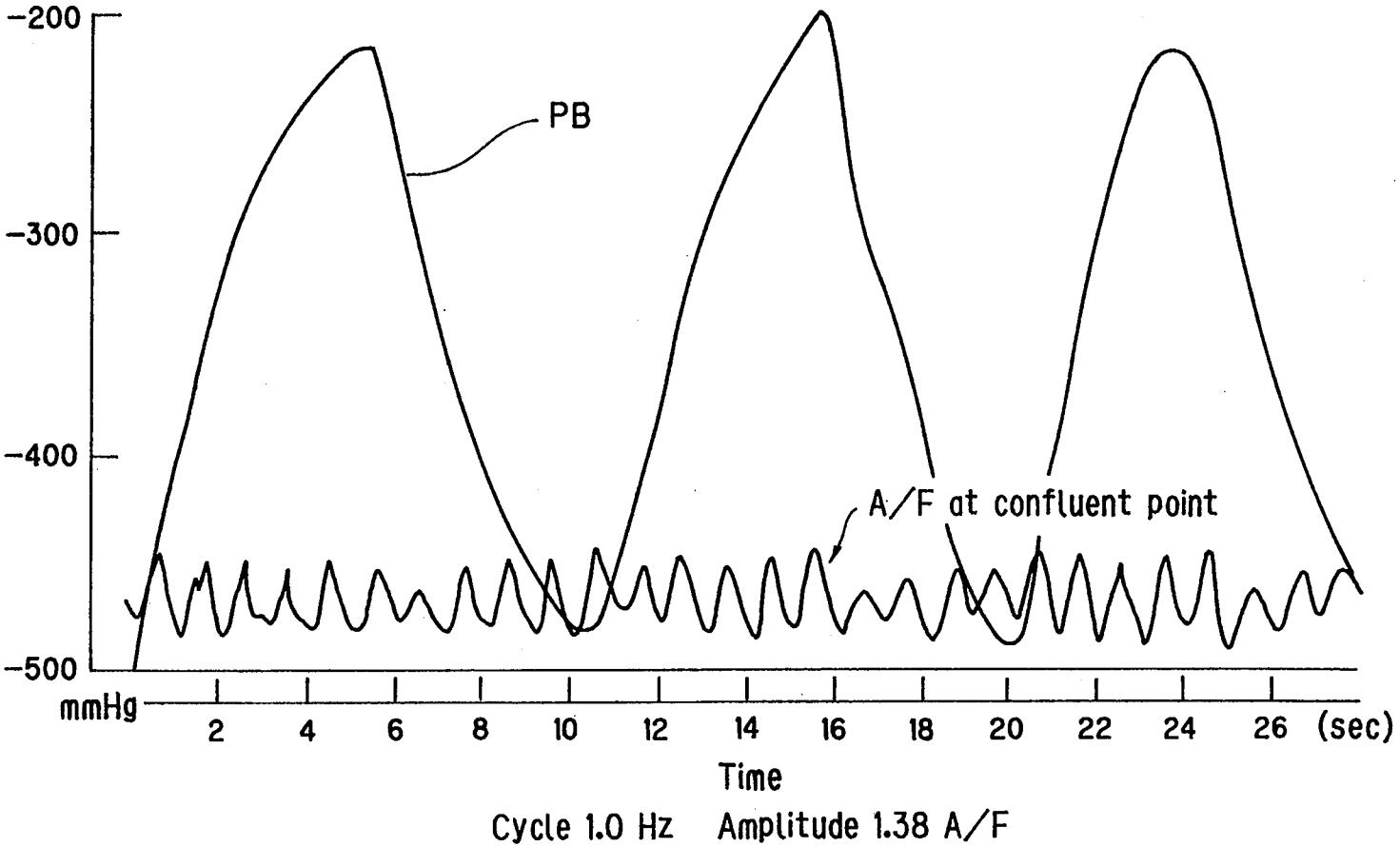
FIG. 15 is a view similar to FIG. 12 but showing results at a transient engine operating condition when the cycle and amplitude of the desired air/fuel ratio are set at 1.0 Hz and 1.38 A/F.
Figure 16:
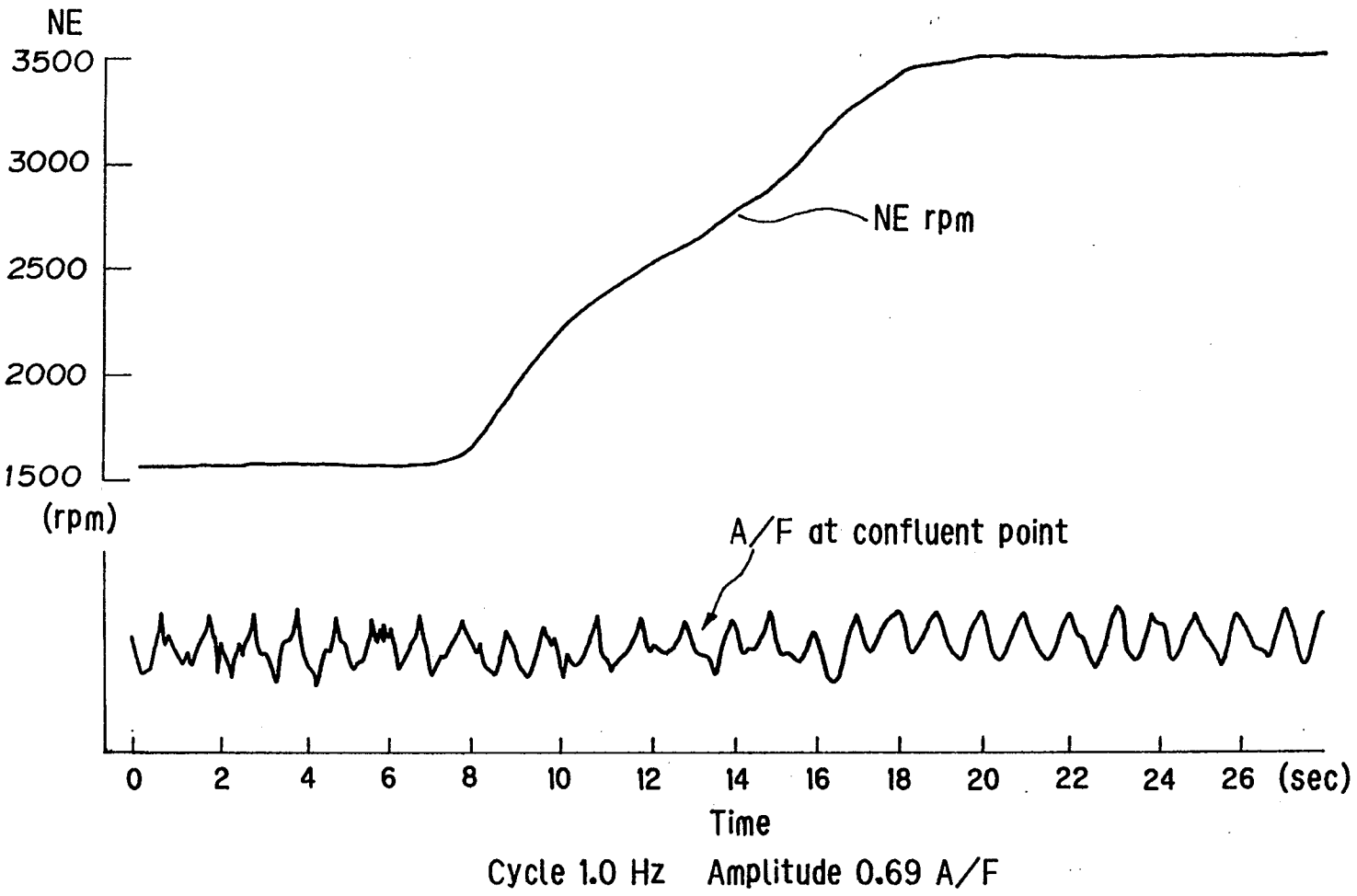
FIG. 16 is a view similar to FIG. 12 but showing results at another transient engine operating conditions when the cycle and amplitude of the desired air/fuel ratio are set at 1.0 Hz and 0.69 A/F.

FIGS. 12 through 16 illustrate the results of a test conducted on a test engine having a similar performance as that disclosed in FIG. 1. FIGS. 12 through 14 illustrate the test results at a steady-state engine operation and FIGS. 15 and 16 illustrate those at transient engine operations. In the steady-state engine operation in FIGS. 12 through 14, the engine speed NE and the manifold absolute pressure PB were fixed at 1500 rpm and 300 mmHg, respectively. The desired air/fuel ratio was set to be 1.0 Hz in cycle and 1.84×A/F in amplitude for FIG. 12, 1.0 Hz and 0.69×A/F for FIG. 13, 0.2 Hz and 0.69×A/F for FIG. 14. In the transient engine operation in FIG. 15, the manifold absolute pressure PB was varied as illustrated when the desired air/fuel was set to be 1.0 Hz in cycle and 1.38×A/F in amplitude. In FIG. 16, the engine speed NE was varied from 1500 through 3500 rpm while the desired air/fuel ratio was fixed at 1.0 Hz in cycle and 0.69×A/F in amplitude. The amplitude was expressed by a multiplication by the air/fuel ratio. It will be seen from the figures that the air/fuel ratios at the exhaust confluence point were approximately constant in cycle and amplitude, not only at the steady-state engine operation, but also during transient engine operations.

With this arrangement, it becomes possible to make the cycle and amplitude of the desired air/fuel ratio constant irrespective of the changes in the engine operating conditions. This owes partially to the fact that the desired air/fuel ratio (more correctly the perturbation correction coefficient KWAVE) is set with respect to time and is sampled by the TDC interval so as to be free from the change of the engine speed NE.

Further, with the arrangement, it will be easily understood that the air/fuel ratio is controlled in an open-loop fashion when the engine is started or fully throttled.

Figure 17:
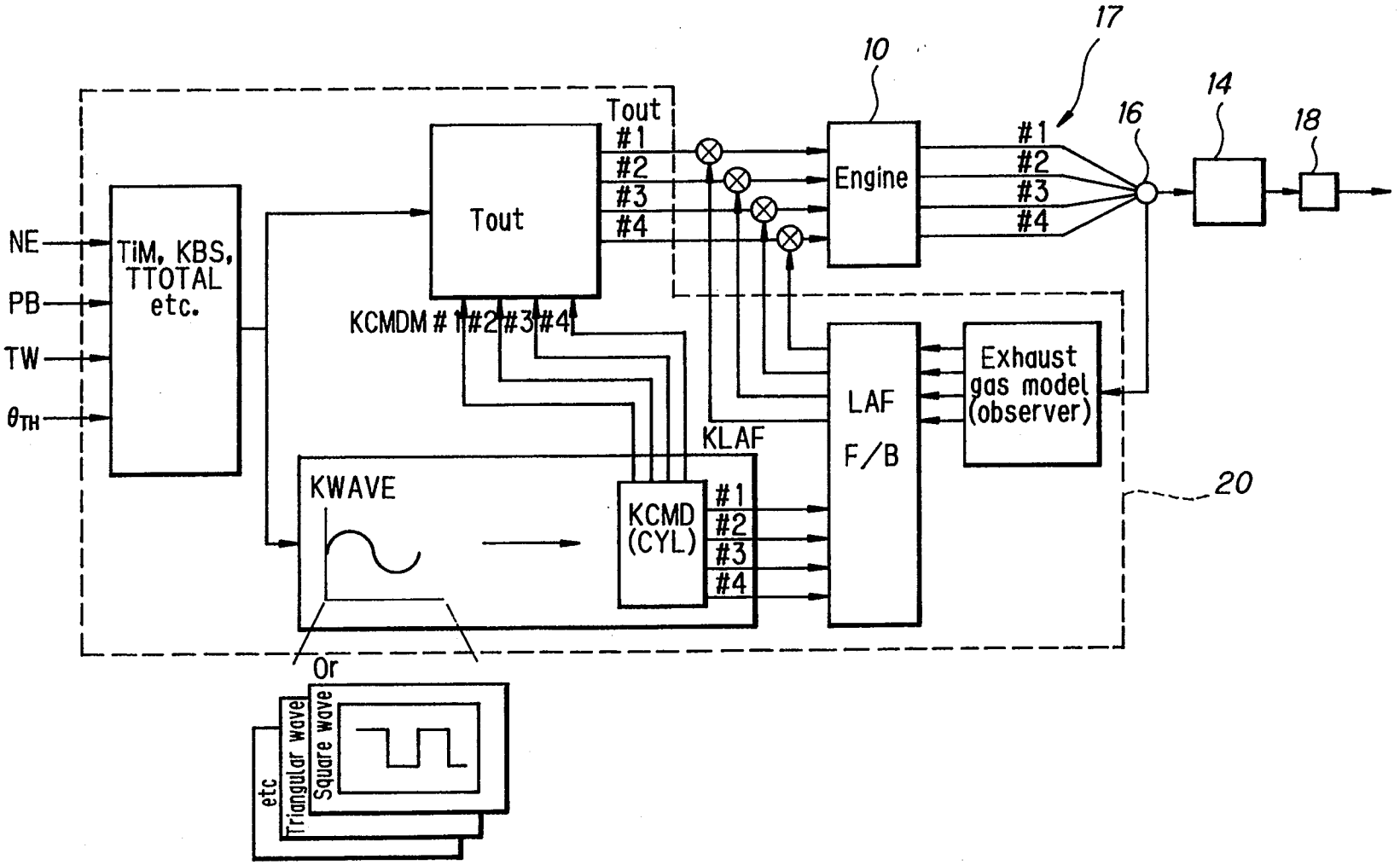
FIG. 17 is a view similar to FIG. 1 but showing an air/fuel ratio control system according to a second embodiment of the present invention.

FIG. 17 is a block diagram showing the air/fuel ratio control system according to a second embodiment of the invention.

In the second embodiment, only one LAF sensor 16 is installed at the confluence point of the exhaust system downstream of the exhaust manifold 17 and air/fuel ratios at the individual cylinders are estimated from the sensor output using an exhaust gas model explained below. Since, however, this was explained in the assignee's Japanese Laid-Open Patent Publication Hei 5(1993)-180,044; also filed in the United States on Dec. 24, 1992 under the Ser. No. of 07/997,769, it will be explained here only briefly.

Figure 18:
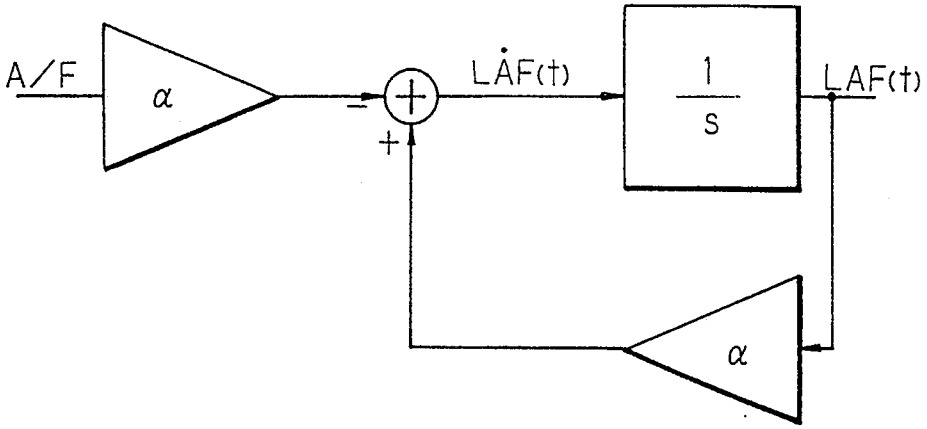
FIG. 18 is a block diagram showing a model describing the behavior of detection of the air/fuel ratio sensor illustrated in FIG. 17.

For high-accuracy separation and extraction of the air/fuel ratios of the individual cylinders from the output of the single LAF sensor 16, it is first necessary accurately to ascertain the detection response lag of the LAF sensor 16. This lag is assumed to be a first-order lag and for this, a model shown in FIG. 18 is established. Here, if we define LAF as LAF sensor output and A/F as input air/fuel ratio, the state equation can be written as:

$$\dot{LAF}(t)=\alpha LAF(t)-\alpha A/F(t) \quad (1)$$

When the state equation is discretized in the discrete-time series for period delta T, we get $$LAF(k+1)=\hat{\alpha}LAF(k)+(1-\hat{\alpha})A/F(k) \quad (2)$$

here $$\hat{\alpha}=1+\alpha\Delta T+(\tfrac{1}{2}!)\alpha^2\Delta T^2+(1/3!)\alpha^3\Delta T^3+(\tfrac{1}{4}!)\alpha^4\Delta T^4.$$

Figure 19:
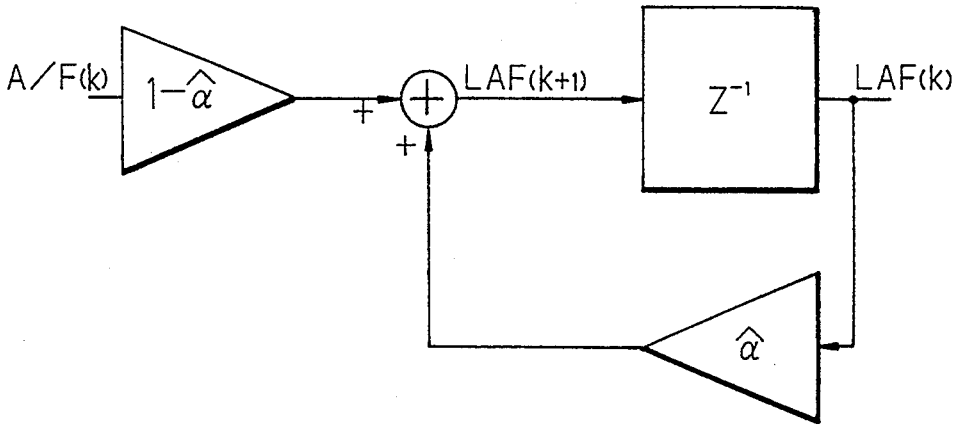
FIG. 19 is a block diagram showing the model of FIG. 18 discretized (sampled) in the discrete-time series for period delta T.

Equation (2) is represented as a block diagram in FIG. 19.

Therefore, Equation (2) can be used to obtain the actual air/fuel ratio from the sensor output. That is to say, since Equation (2) can be rewritten as Equation (3), the value at time k−1 can be calculated back from the value at time k as shown by Equation (4).

$$A/F(k)=\{LAF(k+1)-\hat{\alpha}LAF(k)\}/(1-\hat{\alpha}) \quad (3)$$

$$A/F(k-1)=\{LAF(k)-\hat{\alpha}LAF(k-1)\}/(1-\hat{\alpha}) \quad (4)$$

Figure 20:
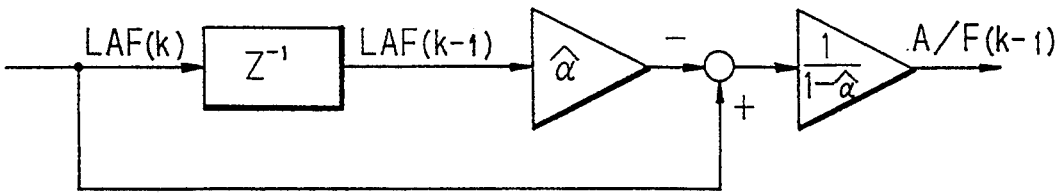
FIG. 20 is a block diagram showing a real-time estimator based on the model of FIG. 19.

Specifically, use of Z transformation to express Equation (2) in transfer function gives Equation (5), and a real-time estimate of the air/fuel ratio in the preceding cycle can be thus obtained by multiplying the sensor output LAF of the current cycle by its inverse transfer function. FIG. 20 is a block diagram of the real-time estimator.

$$t(z)=(1-\hat{\alpha})/(Z-\hat{\alpha}) \quad (5)$$

The separation and extraction of the air/fuel ratios of the individual cylinders using the air/fuel ratio estimated in the foregoing manner will now be explained.

As was mentioned in the earlier application, the air/fuel ratio at the confluence point of the exhaust system is assumed to be an average weighted to reflect the time-based contribution of the air/fuel ratios of the individual cylinders. This makes it possible to express the air/fuel ratio at the confluence point at time k in the manner of Equation (6). As F (fuel) was selected as the controlled variable in the exhaust gas model, the term fuel/air ratio F/A is used instead of the air/fuel ratio A/F in the figure. However, for ease of understanding, the word "air/fuel ratio" will still be used in the following except where the use of the word might cause confusion. Here, the #n in the equation indicates the cylinder number, and the firing order of the cylinders is defined as 1, 3, 4, 2. The air/fuel ratio here (correctly the fuel/air ratio (F/A)) is the estimated value obtained by correcting for the response lag.

$$\begin{aligned}[F/A](k) &= C_1[F/A\#_1]+C_2[F/A\#_3]+C_3[F/A\#_4]+C_4[F/A\#_2] \quad (6)\\ [F/A](k+1) &= C_1[F/A\#_3]+C_2[F/A\#_4]+C_3[F/A\#_2]+C_4[F/A\#_1]\\ [F/A](k+2) &= C_1[F/A\#_4]+C_2[F/A\#_2]+C_3[F/A\#_1]+C_4[F/A\#_3]\\ &\vdots\end{aligned}$$

Figure 21:
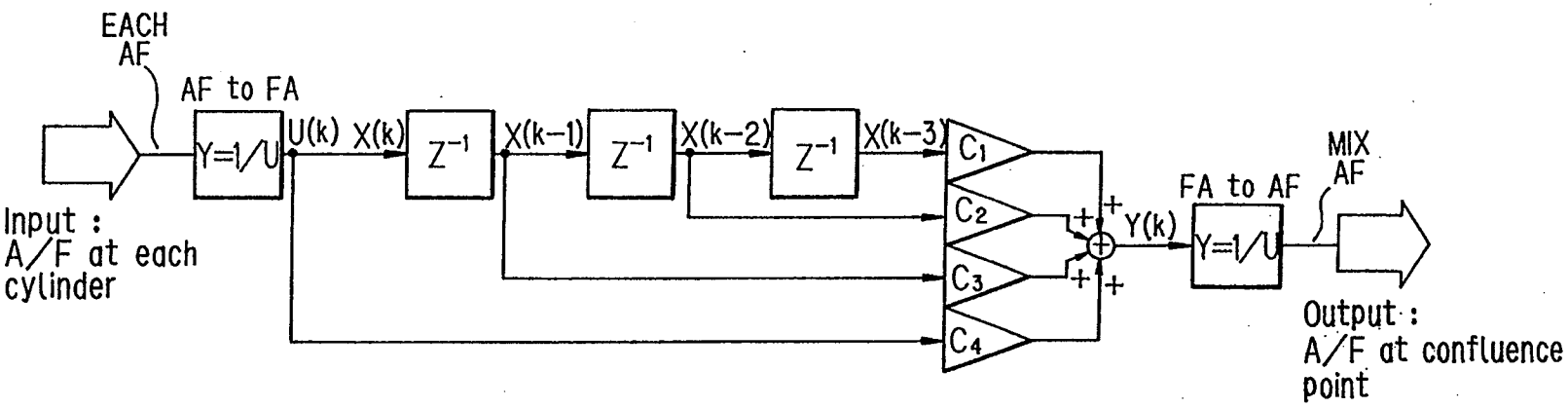
FIG. 21 is a block diagram showing an exhaust gas model describing the behavior of the exhaust system of the engine.

More specifically, the air/fuel ratio at the confluence point can be modeled as the sum of the products of the past firing histories of the respective cylinders and weights C (for example, 40% for the cylinder that fired most recently, 30% for the one before that, and so on). The model is shown in block diagram in FIG. 21 (hereinafter called the "exhaust gas model"). The state equation of the exhaust gas model can be written as $$\begin{pmatrix} x(k-2)\\ x(k-1)\\ x(k)\end{pmatrix}=\begin{pmatrix}010\\001\\000\end{pmatrix}\begin{pmatrix}x(k-3)\\x(k-2)\\x(k-1)\end{pmatrix}+\begin{pmatrix}0\\0\\1\end{pmatrix}u(k) \quad (7)$$

Further, if the air/fuel ratio at the confluence point is defined as y(k), the output equation can be written as $$y(k)=[C_1C_2C_3]\begin{pmatrix}x(k-3)\\x(k-2)\\x(k-1)\end{pmatrix}+C_4u(k) \quad (8)$$

Here $C_1=0.25379$, $C_2=0.46111$, $C_3=0.10121$, $C_4=0.18389$.

Since u(k) in this equation cannot be observed, it will still not be possible, even if an observer is designed from the equation, to observe x(k). However, if one defines x(k+1)=x(k−3) on the assumption of a stable operating state in which there is no abrupt change in the air/fuel ratio from that 4 TDC earlier (i.e., from that of the same cylinder), Equation (9) will be obtained.

$$\begin{pmatrix} x(k-2) \\ x(k-1) \\ x(k) \\ x(k+1) \end{pmatrix} = \begin{pmatrix} 0100 \\ 0010 \\ 0001 \\ 1000 \end{pmatrix} \begin{pmatrix} x(k-3) \\ x(k-2) \\ x(k-1) \\ x(k) \end{pmatrix} \tag{9}$$

$$y(k) = [C_1C_2C_3C_4] \begin{pmatrix} x(k-3) \\ x(k-2) \\ x(k-1) \\ x(k) \end{pmatrix}$$

Figure 22:
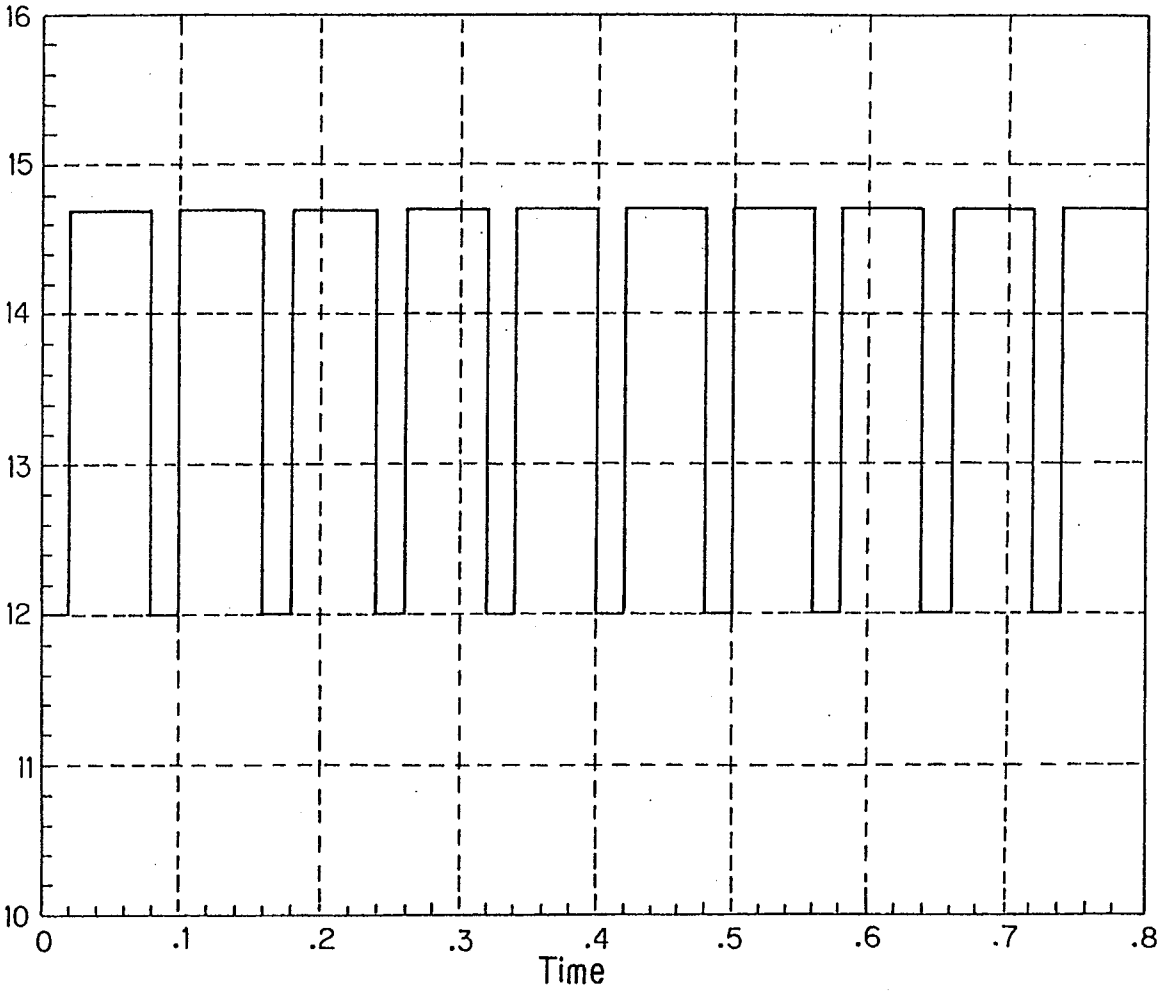
FIG. 22 is a view showing a simulation using the model illustrated in FIG. 21 on the assumption that fuel is supplied to three cylinders of the four-cylinder engine so as to obtain an air/fuel ratio of 14.7:1, and to one cylinder so as to obtain an air/fuel ratio of 12.0:1.
Figure 23:
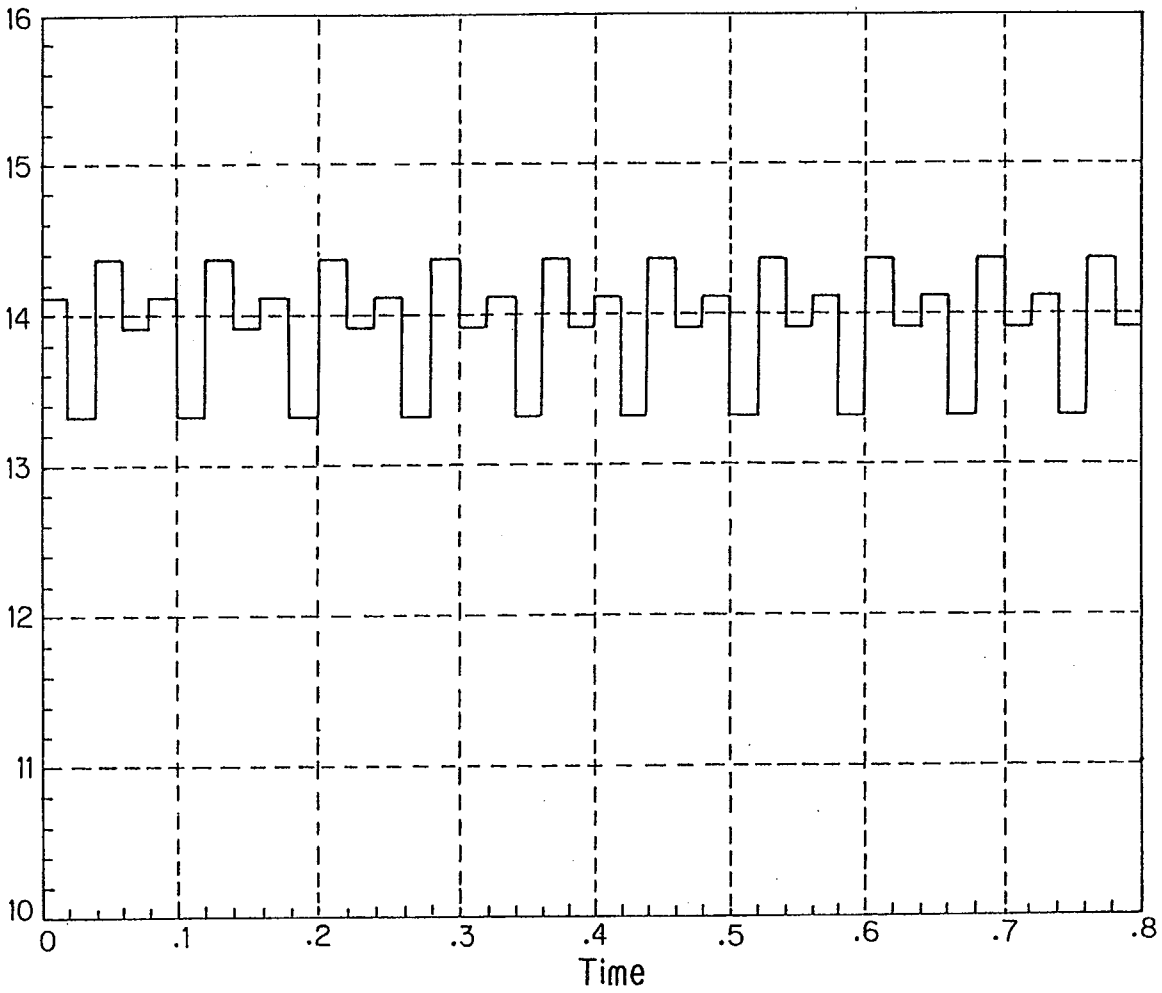
FIG. 23 is the result of a simulation showing the output of the exhaust gas model indicative of the air/fuel ratio at a confluence point of the exhaust system of the engine, when the fuel is supplied in the manner illustrated in FIG. 22.
Figure 24:
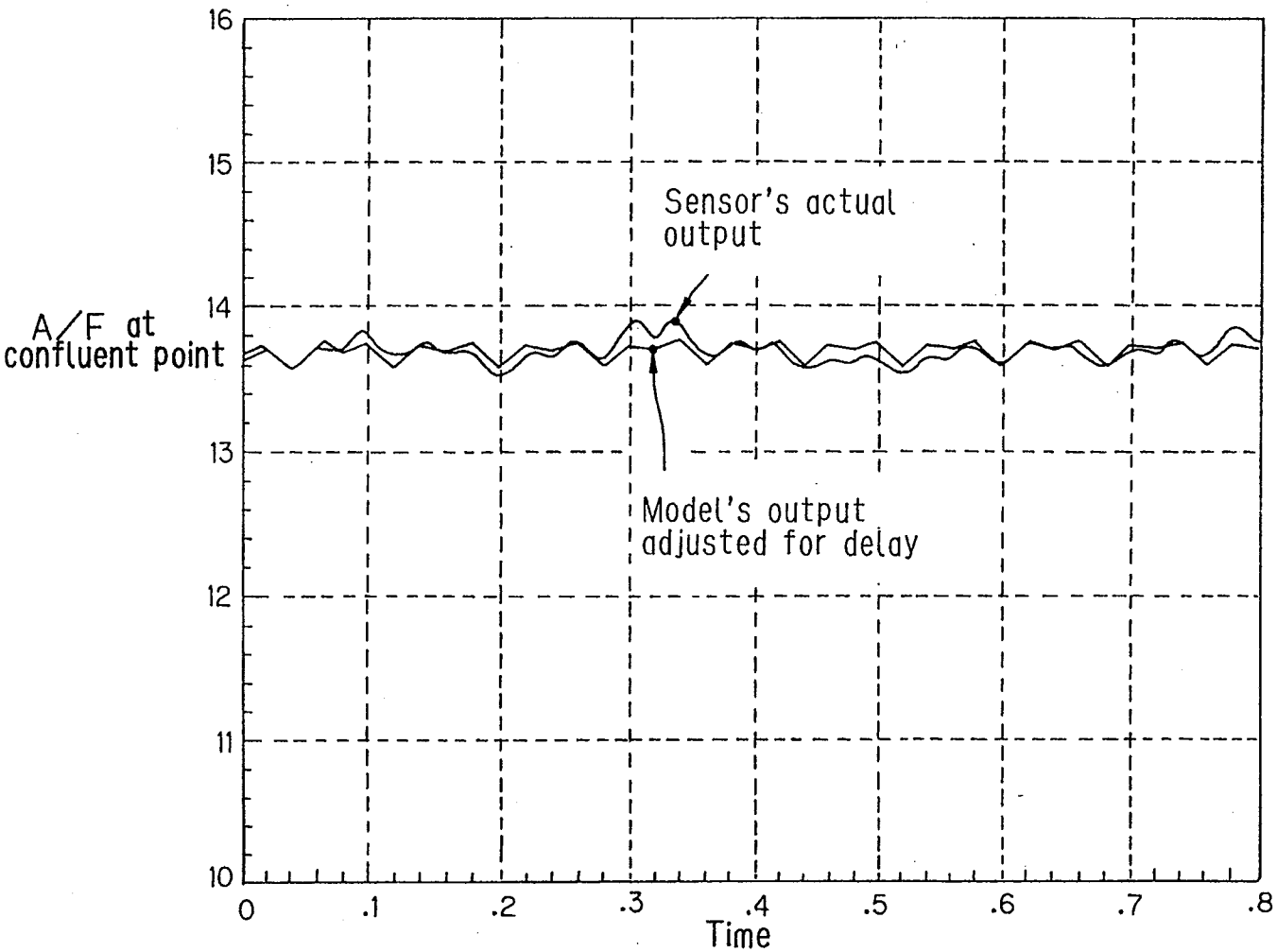
FIG. 24 is another result of a simulation showing the output of the exhaust gas model adjusted for sensor detection response delay in contrast with the sensor's actual output.

The result of a simulation for the exhaust gas model obtained in the foregoing manner will now be given. FIG. 22 shows an example of the simulation in which fuel is supplied to three cylinders of the four-cylinder internal combustion engine so as to obtain an air/fuel ratio of 14.7:1, and to one cylinder so as to obtain an air/fuel ratio of 12.0:1. FIG. 23 is result of the simulation showing the air/fuel ratio at this time at the confluence point, obtained using the aforesaid exhaust gas model. While FIG. 23 shows that a stepped output is obtained, when the aforesaid response delay of the LAF sensor is taken into consideration, the sensor output becomes the smoothed wave designated "Model's output adjusted for delay" in FIG. 24. The close agreement of the wave-forms of the model's output and the sensor's actual output verifies the validity of the exhaust gas model as a model of the exhaust gas system of a multiple cylinder internal combustion engine.

Thus, the problem is reduced to one of an ordinary Kalman filter in which X(k) is observed in the state equation and the output equation shown in Equation (10). When the weighting matrices Q, R are defined as Equation (11) and the Riccati's equation is solved, the gain matrix K becomes as shown in Equation (12).

$$\begin{cases} x(k+1) = AX(k) + Bu(k) \\ y(k) = CX(k) + Du(k) \end{cases} \tag{10}$$

Here:

$$A = \begin{pmatrix} 0100 \\ 0010 \\ 0001 \\ 1000 \end{pmatrix} C = [C_1C_2C_3C_4] B = D = [0]$$

$$X(k) = \begin{pmatrix} x(k-3) \\ x(k-2) \\ x(k-1) \\ x(k) \end{pmatrix}$$

$$Q = \begin{pmatrix} 1000 \\ 0100 \\ 0010 \\ 0001 \end{pmatrix} R = [1] \tag{11}$$

-continued $$K = \begin{pmatrix} -0.3093 \\ 1.1918 \\ 0.3093 \\ 0.0803 \end{pmatrix} \tag{12}$$

Obtaining A-KC from this gives Equation (13).

$$A - KC = \begin{pmatrix} 0.0785 & 1.0313 & 0.1426 & 0.0569 \\ -0.3025 & -0.1206 & 0.4505 & -0.2192 \\ -0.0785 & -0.0313 & -0.1426 & 0.9431 \\ 0.9796 & -0.0081 & -0.0370 & -0.0148 \end{pmatrix} \tag{13}$$

Figure 25:
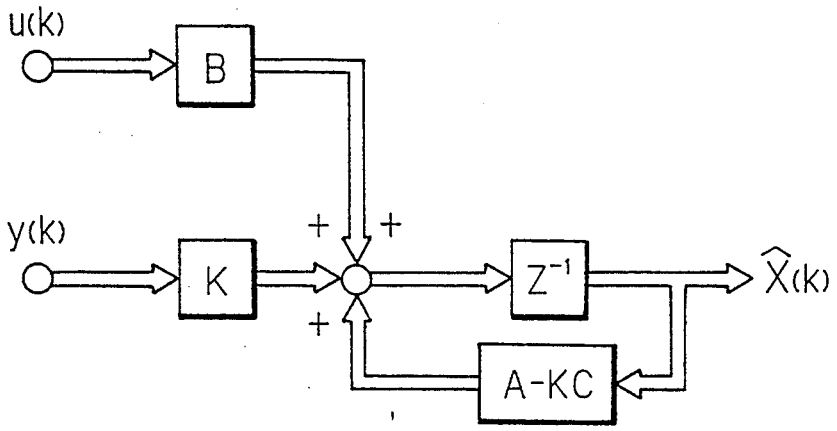
FIG. 25 is a block diagram showing the configuration of an ordinary observer.
Figure 26:
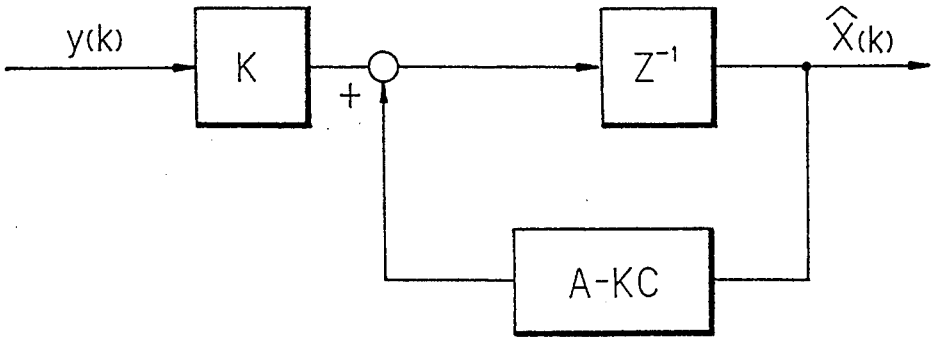
FIG. 26 is a block diagram showing the configuration of an observer used in the second embodiment of the present invention.

FIG. 25 shows the configuration of an ordinary observer. Since there is no input u(k) in the present model, however, the configuration has only y(k) as an input, as shown in FIG. 26. This is expressed mathematically by Equation (14).

$$\begin{cases} \hat{X}(k+1) = [A - KC]\hat{X}(k) + y(k) \\ \hat{x}(k) = [0001]\hat{X}(k) \end{cases} \tag{14}$$

The system matrix S of the observer whose input is y(k), namely of the Kalman filter, is $$S = \begin{pmatrix} A - KC & K \\ 0001 & 0 \end{pmatrix} \tag{15}$$

In the present model, when the ratio of the element of the weight imputation R in the Riccati's equation to the element of Q is 1:1, the system matrix S of the Kalman filter is given as $$S = \begin{pmatrix} 0.0785 & 1.0313 & 0.1426 & 0.0569 & -0.3093 \\ -0.3025 & -0.1206 & 0.4505 & -0.2192 & 1.1918 \\ -0.0785 & -0.0313 & -0.1426 & 0.9431 & 0.3093 \\ 0.9796 & -0.0081 & -0.0370 & -0.0148 & 0.0803 \\ 0.0 & 0.0 & 0.0 & 1.0 & 0.0 \end{pmatrix} \tag{16}$$

Figure 27:
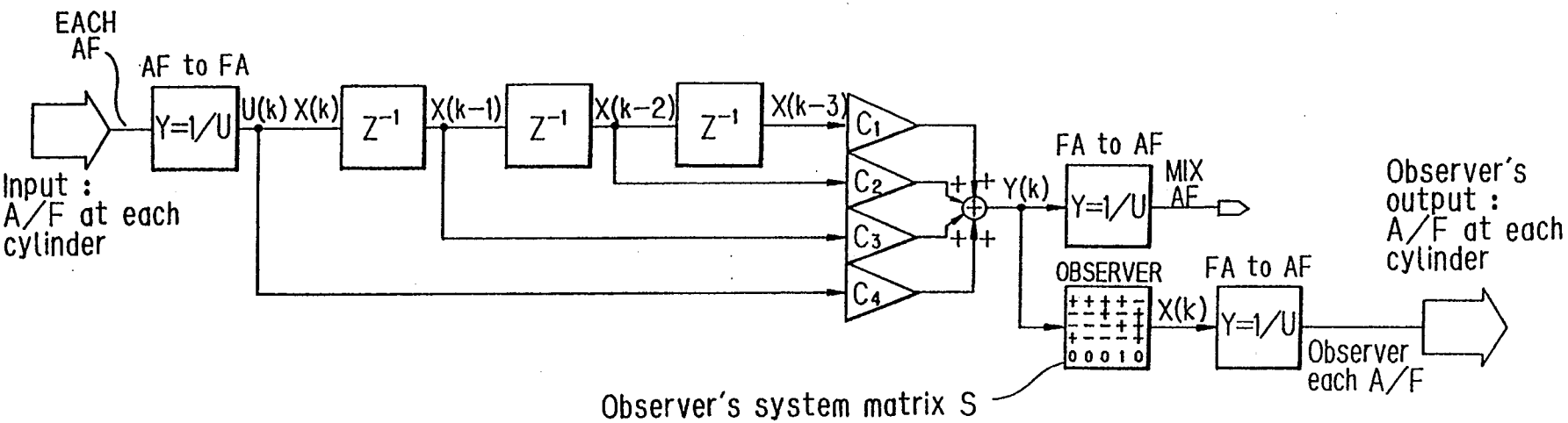
FIG. 27 is a block diagram showing the configuration of the exhaust gas model with the observer illustrated in FIG. 26.

FIG. 27 shows the air/fuel ratio estimator thus obtained. It is now possible to estimate the air/fuel ratios at the individual cylinders from the air/fuel ratio at the exhaust confluence point.

In the second embodiment, the air/fuel ratios at the respective cylinders thus estimated are feedback controlled to the desired air/fuel ratio in the same fashion as that in the first embodiment. Except for the fact that the number of LAF sensor 16 is decreased to one, the configuration as well as advantages of the second embodiment is essentially the same as that in the first embodiment.

Figure 28:
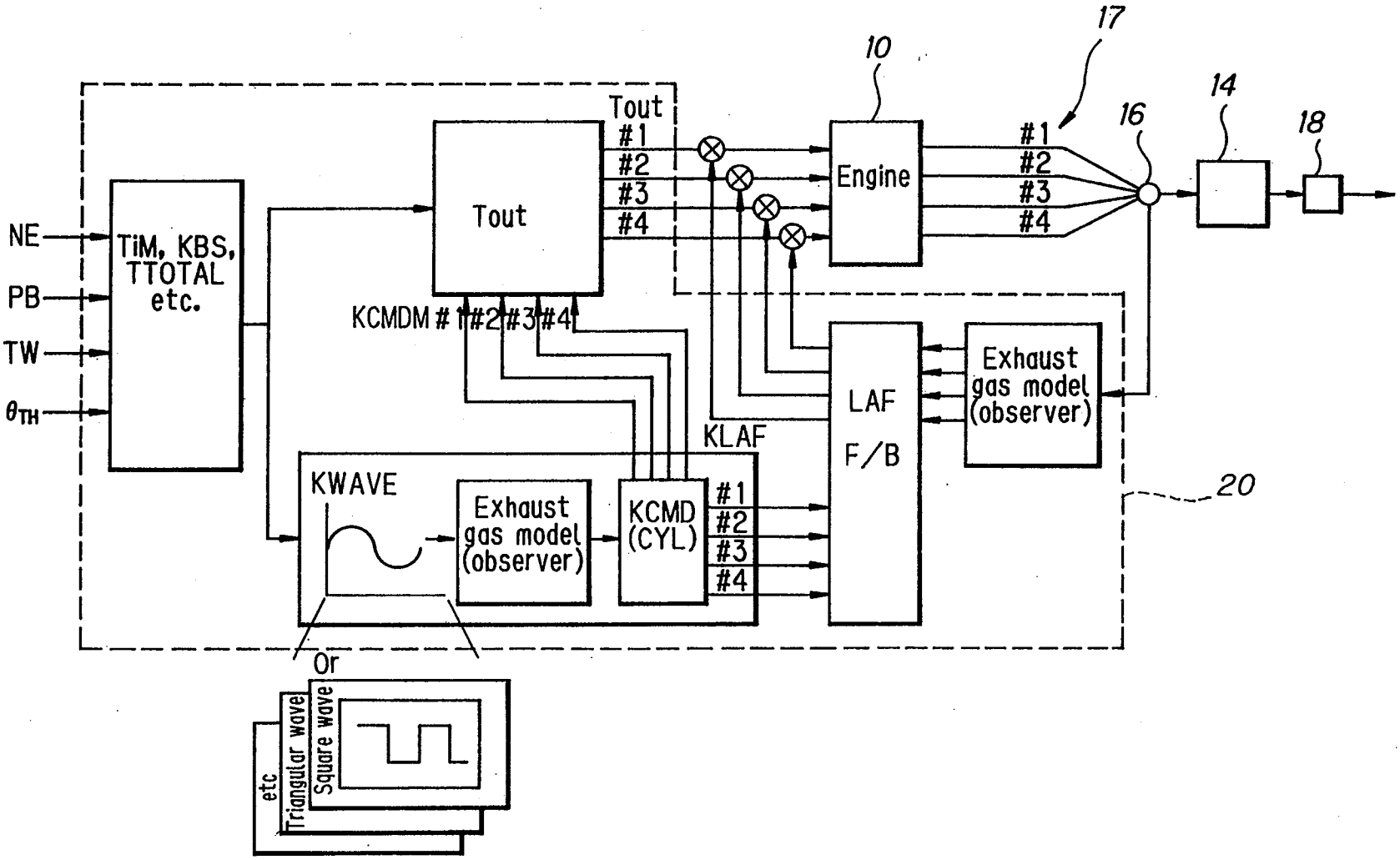
FIG. 28 is a view similar to FIG. 1 but showing an air/fuel ratio control system according to a third embodiment of the invention.

FIG. 28 is a block diagram showing an air/fuel ratio control system according to a third embodiment of the invention.

Figure 29:
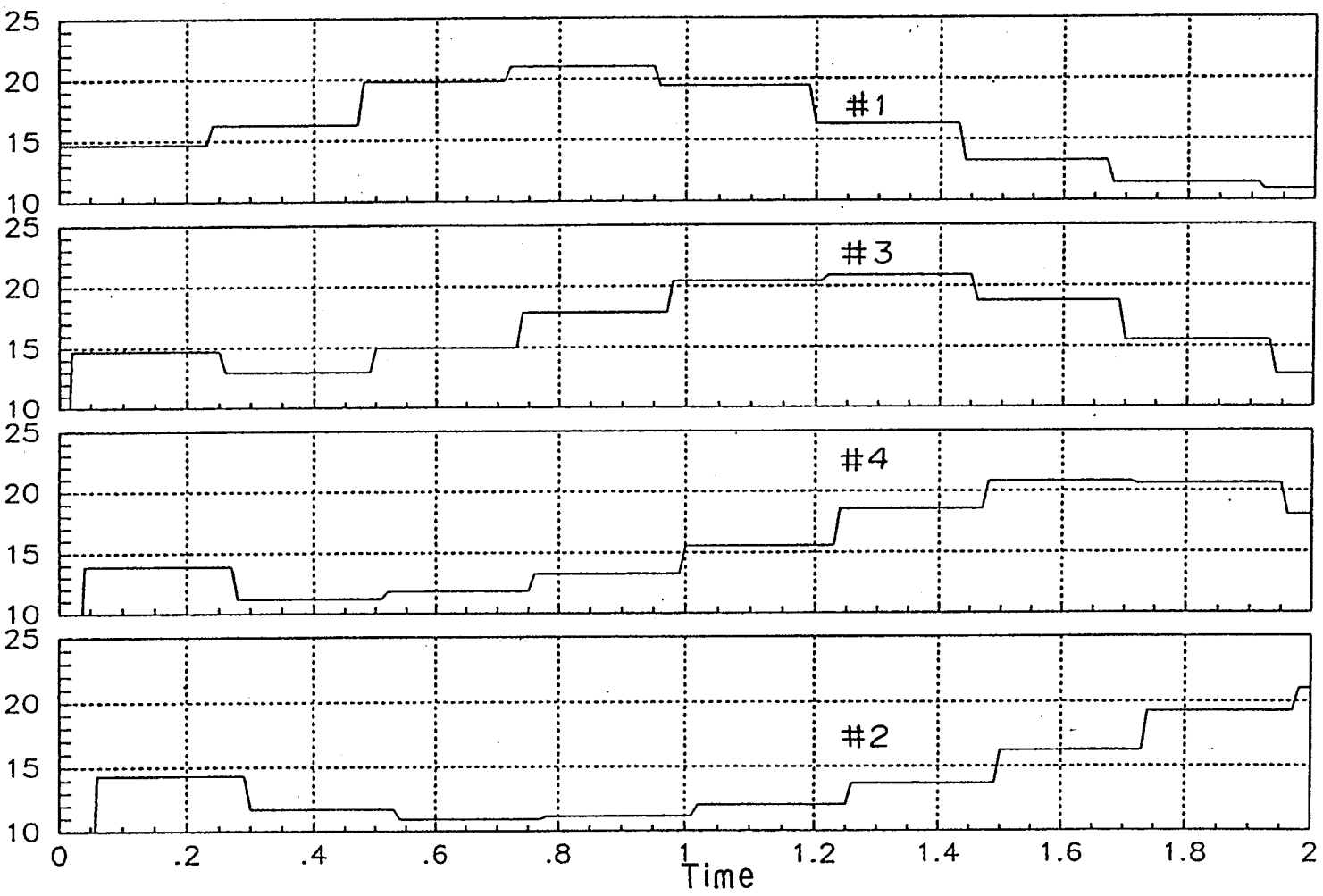
FIG. 29 is a view similar to FIG. 9 but showing the result of a simulation carried out on the control system according to the third embodiment of the present invention.
Figure 30:
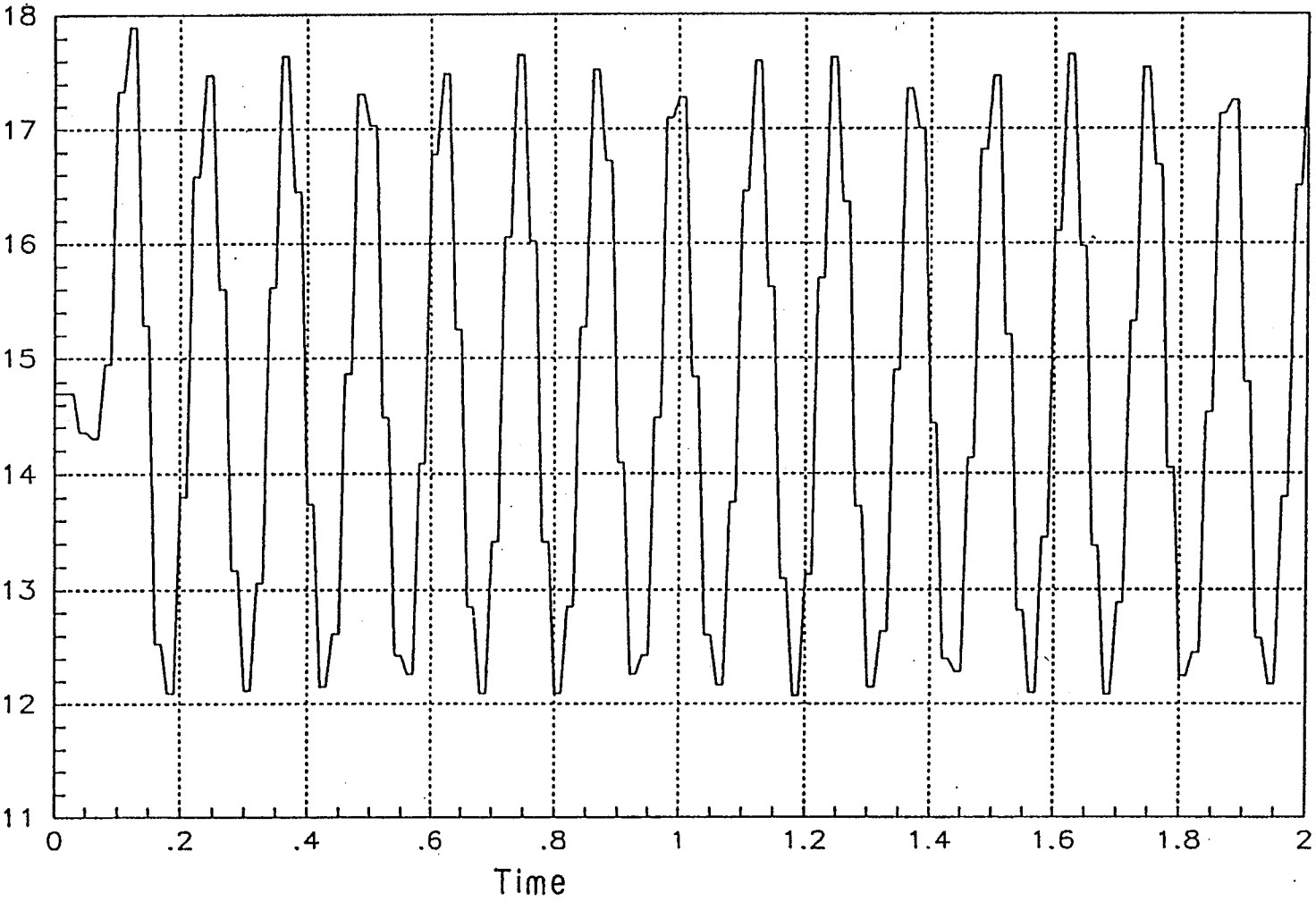
FIG. 30 is a view similar to FIG. 10 but showing the result of a simulation carried out on the control system according to the third embodiment of the present invention.

The third embodiment differs from the foregoing embodiments in that the exhaust gas model is used to distribute the desired air/fuel ratio to the individual cylinders. FIGS. 29 and 30 show the results of a simulation. FIG. 29 illustrates the desired air/fuel ratios at the individual cylinders which are obtained by inputting the desired air/fuel ratio illustrated in FIG. 8 to the exhaust gas model (observer), in order to estimate the desired air/fuel ratios at the individual cylinders. FIG. 30 illustrates the air/fuel ratio at the exhaust confluence point when fuel is supplied in response to the desired air/fuel ratios thus estimated. It will be seen from FIG. 30 that the desired air/fuel ratio was obtained with almost the same cycle and amplitude as those of the initial value was obtained. That is, the amplitude of the desired air/fuel ratio did not decrease in the third embodiment as was experienced in the first embodiment.

Figure 31:
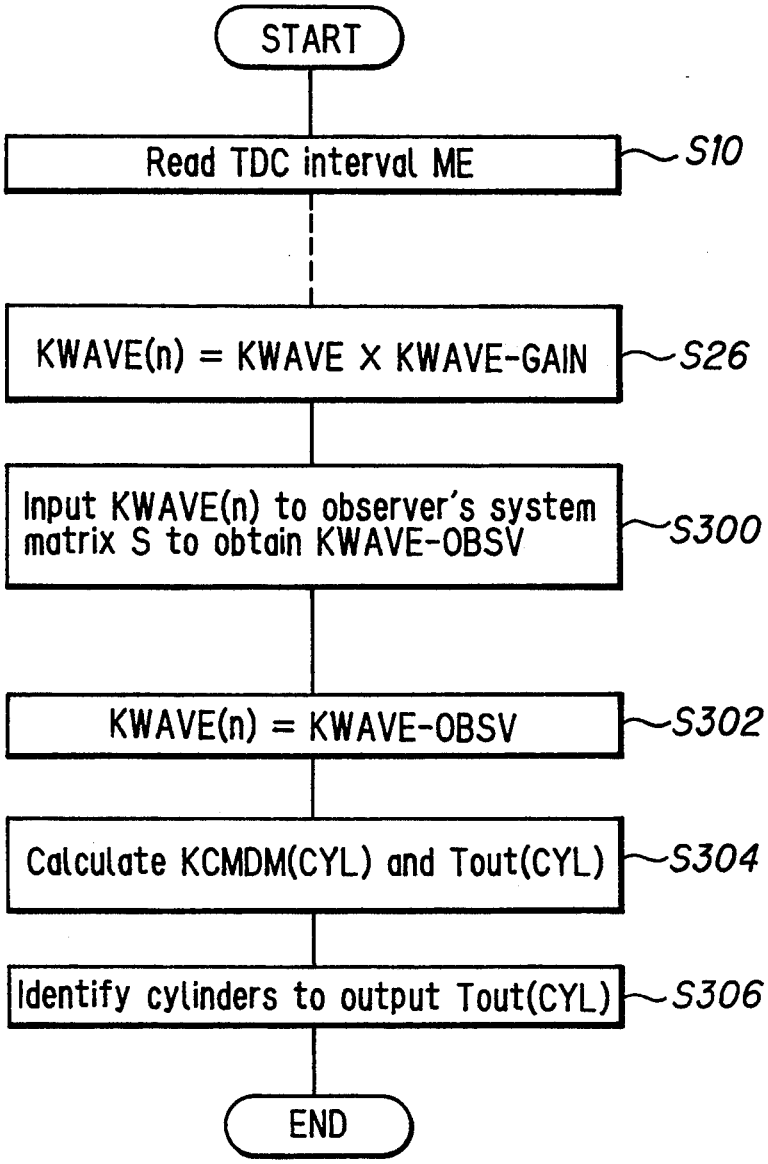
FIG. 31 is a flowchart showing a perturbation control carried out by the control system according to the third embodiment of the present invention illustrated in FIG. 28.

FIG. 31 is a flowchart showing the operation of the control system according to the third embodiment.

The program starts at S10 and the same procedures as those in the first embodiment are taken until the program reaches S26, although steps S14 through S24 are omitted from illustration in the figure. The program then proceeds to S300 in which the perturbation correction coefficient KWAVE(n) is input to the system matrix S of the observer. The value resulting therefrom is named as KWAVE-OBSV. The program then proceeds to S302 in which the value KWAVE-OBSV thus obtained is renamed as the perturbation correction coefficient KWAVE(n), to S304 in which the air/fuel ratio correction coefficient KCMD(CYL) and fuel injection amount Tout(CYL) are calculated in a similar manner to that of the first embodiment, and to S306 in which the cylinders are identified and the fuel injection amount Tout(CYL) is output to the cylinder concerned.

The third embodiment is the same as the foregoing embodiments in configuration and advantages except for the fact that the amplitude of the desired air/fuel ratio need not be corrected.

In the third embodiment, the exhaust gas model is also used to estimate the air/fuel ratios at the individual cylinders as illustrated in FIG. 28. It should be noted, however, that it is alternatively possible to prepare an LAF sensor 16 for each cylinder. Namely, it is alternatively possible to use the model only for distributing the desired air/fuel ratio to the respective cylinders. easily modified to an open-loop air/fuel control system.

It should be noted that, although the sine wave is used as an example of the periodic function, it is alternatively possible to use, as illustrated in FIG. 1, another wave such as a square wave, a triangular wave or the like.

It should further be noted that, although the degree of degradation of the catalytic converter is Judged by comparing the switching periods of the sensors' outputs installed upstream and downstream of the catalytic converter, the invention is not limited to the method in disclosure and it is alternatively possible to use any method other than that.

It should further be noted that, although the oxygen sensor 18 is used at a point downstream of the catalytic converter, it is alternatively possible to use the sensor instead of the oxygen sensor.

The present invention has thus been shown and described with reference to the specific embodiments. However, it should be noted that the present invention is in no way limited to the details of the described arrangements; changes and modifications may be made without departing from the scope of the appended claims.

What is claimed is:

1. A system for controlling an air/fuel ratio of a multicylinder internal combustion engine such that an actual air/fuel ratio, at at least one of upstream and downstream of a catalytic converter installed at an exhaust system of the engine, is intentionally oscillated at least one of its amplitude and cycle, comprising:

first means for establishing a characteristic of a desired air/fuel ratio as a periodic function such that the desired air/fuel ratio varies at at least one of a predetermined amplitude and cycle within a predetermined period;

second means for sampling the characteristic by a time interval determined on the basis of a time interval between TDC crank angle positions of the engine;

third means for determining each cylinder's desired air/fuel ratio from the sampled data;

fourth means for determining a fuel injection amount for each cylinder from each determined cylinder's desired air/fuel ratio; and fifth means for supplying a fuel to each cylinder in response to the determined fuel injection amount.

2. A system according to claim 1, wherein said third means multiplies a coefficient by each determined cylinder's desired air/fuel ratio to adjust its amplitude.

3. A system according to claim 1, wherein said third means includes:

sixth means for assuming an air/fuel ratio at a confluence point of the exhaust system of the engine as an average value made up of a sum of products of past firing histories of each cylinder weighted by a predetermined value, and establishing a model using air/fuel ratios of each cylinder as state variables;

seventh means for obtaining a state equation with respect to the state variables; and an observer that observes the state variables;

and said third means inputs the sampled data to the observer and determines each cylinder's desired air/fuel ratio on the basis of an output of the observer.

4. A system according to claim 2, wherein said third means includes:

sixth means for assuming an air/fuel ratio at a confluence point of the exhaust system of the engine as an average value made up of a sum of products of past firing histories of each cylinder weighted by a predetermined value, and establishing a model using air/fuel ratios of each cylinder as state variables;

seventh means for obtaining a state equation with respect to the state variables; and an observer that observes the state variables;

and said third means inputs the sampled data to the observer and determines each cylinder's desired air/fuel ratio on the basis of an output of the observer.

5. A system according to claim 1, wherein said third means varies at least one of the amplitude and cycle of the desired air/fuel ratio in response to an engine operating parameter.

6. A system according to claim 2, wherein said third means varies at least one of the amplitude and cycle of the desired air/fuel ratio in response to an engine operating parameter.

7. A system according to claim 3, wherein said third means varies at least one of the amplitude and cycle of the desired air/fuel ratio in response to an engine operating parameter.

8. A system according to claim 4, wherein said third means varies at least one of the amplitude and cycle of the desired air/fuel ratio in response to an engine operating parameter.

9. A system according to claim 5, wherein the engine operating parameter is at least one of engine speed and engine load.

10. A system according to claim 6, wherein the engine operating parameter is at least one of engine speed and engine load.

11. A system according to claim 7, wherein the engine operating parameter is at least one of engine speed and engine load.

12. A system according to claim 8, wherein the engine operating parameter is at least one of engine speed and engine load.

13. A system according to claim 1, wherein said third means varies at least one of the amplitude and cycle of the desired air/fuel ratio in response to a degree of degradation of the catalytic converter.

14. A system according to claim 2, wherein said third means varies at least one of the amplitude and cycle of the desired air/fuel ratio in response to a degree of degradation of the catalytic converter.

15. A system according to claim 3, wherein said third means varies at least one of the amplitude and cycle of the desired air/fuel ratio in response to a degree of degradation of the catalytic converter.

16. A system according to claim 4, wherein said third means varies at least one of the amplitude and cycle of the desired air/fuel ratio in response to a degree of degradation of the catalytic converter.

17. A system according to claim 5, wherein said third means varies at least one of the amplitude and cycle of the desired air/fuel ratio in response to a degree of degradation of the catalytic converter.

18. A system according to claim 6, wherein said third means varies at least one of the amplitude and cycle of the desired air/fuel ratio in response to a degree of degradation of the catalytic converter.

19. A system according to claim 7, wherein said third means varies at least one of the amplitude and cycle of the desired air/fuel ratio in response to a degree of degradation of the catalytic converter.

20. A system according to claim 8, wherein said third means varies at least one of the amplitude and cycle of the desired air/fuel ratio in response to a degree of degradation of the catalytic converter.

21. A system according to claim 9, wherein said third means varies at least one of the amplitude and cycle of the desired air/fuel ratio in response to a degree of degradation of the catalytic converter.

22. A system according to claim 10, wherein said third means varies at least one of the amplitude and cycle of the desired air/fuel ratio in response to a degree of degradation of the catalytic converter.

23. A system according to claim 11, wherein said third means varies at least one of the amplitude and cycle of the desired air/fuel ratio in response to a degree of degradation of the catalytic converter.

24. A system according to claim 12, wherein said third means varies at least one of the amplitude and cycle of the desired air/fuel ratio in response to a degree of degradation of the catalytic converter.

25. A system according to claim 1, wherein said third means determines the actual air/fuel ratio at each cylinder and determines each cylinder's desired air/fuel ratio such that a deviation from the determined actual air/fuel ratio decreases.

26. A system according to claim 2, wherein said third means determines the actual air/fuel ratio at each cylinder and determines each cylinder's desired air/fuel ratio such that a deviation from the determined actual air/fuel ratio decreases.

27. A system according to claim 3, wherein said third means determines the actual air/fuel ratio at each cylinder and determines each cylinder's desired air/fuel ratio such that a deviation from the determined actual air/fuel ratio decreases.

28. A system according to claim 5, wherein said third means determines the actual air/fuel ratio at each cylinder and determines each cylinder's desired air/fuel ratio such that a deviation from the determined actual air/fuel ratio decreases.

29. A system according to claim 13, wherein said third means determines the actual air/fuel ratio at each cylinder and determines each cylinder's desired air/fuel ratio such that a deviation from the determined actual air/fuel ratio decreases.

30. A system according to claim 25, wherein an air/fuel ratio sensor is provided for each cylinder and said third means determines the actual air/fuel ratio at each cylinder from an output of the air/fuel ratio sensor.

31. A system according to claim 26, wherein an air/fuel ratio sensor is provided for each cylinder and said third means determines the actual air/fuel ratio at each cylinder from an output of the air/fuel ratio sensor.

32. A system according to claim 27, wherein an air/fuel ratio sensor is provided for each cylinder and said third means determines the actual air/fuel ratio at each cylinder from an output of the air/fuel ratio sensor.

33. A system according to claim 28, wherein an air/fuel ratio sensor is provided for each cylinder and said third means determines the actual air/fuel ratio at each cylinder from an output of the air/fuel ratio sensor.

34. A system according to claim 29, wherein an air/fuel ratio sensor is provided for each cylinder and said third means determines the actual air/fuel ratio at each cylinder from an output of the air/fuel ratio sensor.

35. A system according to claim 25, further including:

an air/fuel ratio sensor provided at a confluence point of the exhaust system;

eighth means for assuming an output of the air/fuel ratio indicative of the actual air/fuel ratio at the confluence point of the exhaust system of the engine as an average value made up of a sum of products of past firing histories of each cylinder weighted by a predetermined value, and establishing a model using air/fuel ratios of each cylinder as state variables;

ninth means for obtaining a state equation with respect to the state variables; and an observer that observes the state variables;

and said third means determines the each cylinder's actual air/fuel ratio on the basis of an output of the observer.

36. A system according to claim 26, further including:

an air/fuel ratio sensor provided at a confluence point of the exhaust system;

eighth means for assuming an output of the air/fuel ratio indicative of the actual air/fuel ratio at the confluence point of the exhaust system of the engine as an average value made up of a sum of products of past firing histories of each cylinder weighted by a predetermined value, and establishing a model using air/fuel ratios of each cylinder as state variables;

ninth means for obtaining a state equation with respect to the state variables; and an observer that observes the state variables;

and said third means determines the each cylinder's actual air/fuel ratio on the basis of an output of the observer.

37. A system according to claim 27, further including:

an air/fuel ratio sensor provided at a confluence point of the exhaust system;

eighth means for assuming an output of the air/fuel ratio indicative of the actual air/fuel ratio at the confluence point of the exhaust system of the engine as an average value made up of a sum of products of past firing histories of each cylinder weighted by a predetermined value, and establishing a model using air/fuel ratios of each cylinder as state variables;

ninth means for obtaining a state equation with respect to the state variables; and an observer that observes the state variables;

and said third means determines the each cylinder's actual air/fuel ratio on the basis of an output of the observer.

38. A system according to claim 28, further including:

an air/fuel ratio sensor provided at a confluence point of the exhaust system;

eighth means for assuming an output of the air/fuel ratio indicative of the actual air/fuel ratio at the confluence point of the exhaust system of the engine as an average value made up of a sum of products of past firing histories of each cylinder weighted by a predetermined value, and establishing a model using air/fuel ratios of each cylinder as state variables;

ninth means for obtaining a state equation with respect to the state variables; and an observer that observes the state variables;

and said third means determines the each cylinder's actual air/fuel ratio on the basis of an output of the observer.

39. A system according to claim 29, further including:

an air/fuel ratio sensor provided at a confluence point of the exhaust system;

eighth means for assuming an output of the air/fuel ratio indicative of the actual air/fuel ratio at the confluence point of the exhaust system of the engine as an average value made up of a sum of products of past firing histories of each cylinder weighted by a predetermined value, and establishing a model using air/fuel ratios of each cylinder as state variables;

ninth means for obtaining a state equation with respect to the state variables; and an observer that observes the state variables;

and said third means determines the each cylinder's actual air/fuel ratio on the basis of an output of the observer.

* * * * *